US006286348B1

(12) United States Patent
Sekiguchi et al.

(10) Patent No.: US 6,286,348 B1
(45) Date of Patent: Sep. 11, 2001

(54) STRIP THICKNESS CONTROLLER FOR ROLLING MILL

(75) Inventors: Kunio Sekiguchi, Kawagoe; Yosuke Tonami, Asaka; Takashi Chujo, Tachikawa, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/533,664

(22) Filed: Mar. 23, 2000

(30) Foreign Application Priority Data

Apr. 9, 1999 (JP) ..... 11-102061

(51) Int. Cl.[7] ..... B21B 37/00

(52) U.S. Cl. ..... 72/9.2; 72/10.3; 72/11.5; 72/11.8

(58) Field of Search ..... 72/9.2, 10.1, 10.3, 72/10.4, 10.7, 11.8, 8.8, 11.5, 12.5

(56) References Cited

U.S. PATENT DOCUMENTS

| | | | | |
|---|---|---|---|---|
| 4,222,254 | * | 9/1980 | King, Jr. et al. | 72/10.4 |
| 4,685,063 | * | 8/1987 | Weihrich et al. | 72/10.4 |
| 4,850,211 | | 7/1989 | Sekiguchi et al. | 72/8 |
| 4,910,985 | | 3/1990 | Ballyns | 72/8 |
| 5,077,997 | | 1/1992 | Wolters et al. | 72/8 |
| 5,181,408 | | 1/1993 | Yeh et al. | 72/11 |
| 5,647,237 | * | 7/1997 | Jungkunz et al. | 72/10.1 |
| 5,647,238 | * | 7/1997 | Steidl et al. | 72/10.1 |

FOREIGN PATENT DOCUMENTS

| | | | | |
|---|---|---|---|---|
| 62-16811 | * | 1/1987 | (JP) | 72/10.1 |
| 6-182443 | * | 7/1994 | (JP) | 72/10.1 |

* cited by examiner

*Primary Examiner*—Ed Tolan
(74) *Attorney, Agent, or Firm*—Foley & Lardner

(57) ABSTRACT

A strip thickness controller for a rolling mill, which is capable of reducing a delivery-side strip thickness deviation due to an eccentricity of a backup roll even in a rolling mill incapable of easily performing a kiss-roll. The strip thickness controller provides with a thickness gauge, provided in a position spaced a distance shorter than a circumference of each of backup rolls on a delivery side of the mill, for detecting a strip thickness deviation from a set value, an angle detecting unit for outputting a rotational angle detection signal at every equally-segmented portion when an angle of one rotation of the backup roll is, with "n" being a positive integer, segmented equally by "n", a calculating unit for calculating a forward slip of the mill at a point of time when a first rotational angle detection signals outputted, and calculating, based on the forward slip and the circumference of the backup roll, a delivery-side strip length of the rolling mill which corresponds to one rotation of the backup roll and a delaying unit for delaying a strip thickness deviation signal of the thickness gauge by a strip transfer time corresponding to a difference between the delivery-side strip length calculated by the calculating unit and a distance of the thickness gauge from the rolling mill.

16 Claims, 15 Drawing Sheets

STRIP THICKNESS CONTROLLER FOR ROLLING MILL

FIELD OF THE INVENTION

The present invention relates to a strip thickness controller for a rolling mill, for controlling delivery thickness of the strip in the rolling mill.

BACKGROUND OF THE INVENTION

There are a variety of rolling mills for rolling a steel plate etc., of which categories differ depending on the number of rolling rolls per stand. What the present invention is applied to, is a rolling mill including at least a pair of backup rolls disposed up and down. The following discussion will concentrate on a four-high rolling mills including a pair of work rolls and a pair of backup rolls.

A roll eccentricity of the rolling mill may be a large disturbance to control of a thickness of the strip or to tension control. Principal factors for causing the roll eccentricity are:

(a) an influence of a bearing key of the backup roll, (b) a bias of an axial core of the backup roll, and (c) ill-formed roundness of the work roll.

The eccentricity caused by the factor (a) among these factors, it is conceived, has the largest eccentric quantity.

A variety of methods of reducing the roll eccentricity in a control-based manner have been proposed and applied to a multiplicity of rolling plants. A typical method thereof is disclosed in JP 51-138468 A. According to this method, a rolling force signal detected corresponding to a rotational angle of the backup roll is Fourier-transformed, then a frequency component synchronizing with the rotation of the backup roll is extracted, and a roll gap is controlled by use of this frequency component.

Based on this prior art method, a rolling force generated by rotating and making the up-an-down rolls contact with each other in a non-rolling state, i.e., by performing a so-called kiss-roll, is detected and Fourier-transformed, thereby detecting a roll eccentricity. This method may be said to have a high detection accuracy because of only the roll eccentricity appearing in a rolling force signal generated. With a progress of rolling process, however, a state of the rolls might change, and hence a requirement for adopting this method is that the kiss-roll can be easily done in order to respond to that change. This method is therefore hard to be applied to a tandem rolling mill incapable of easily performing the kiss-roll, and it is, if applied, difficult to attain high-accuracy control.

SUMMARY OF THE INVENTION

Accordingly, it is a primary object of the present invention to provide a strip thickness controller for a rolling mill, which is capable of reducing a delivery-side strip thickness deviation due to an eccentricity of a backup roll even in a rolling mill incapable of easily performing a kiss-roll.

To accomplish the above object, according to a first aspect of the present invention, a strip thickness controller for a rolling mill comprises a thickness gauge, provided in a position spaced a distance shorter than a circumference of each of backup rolls of the rolling mill on a delivery side of the rolling mill having work rolls and the backup rolls, for detecting a strip thickness deviation from a strip thickness set value, a rotational angle detecting unit for outputting a rotational angle detection signal at every equally-segmented portion when an angle of one rotation of the backup roll is, with "n" being a positive integer, segmented equally by "n", a strip length calculating unit for calculating a forward slip of the length calculating unit for calculating a forward slip of the rolling mill at a point of time when a first rotational angle detection signal is outputted from the rotational angle detecting unit, and calculating, based on the forward slip and the circumference of the backup roll or a value relative thereto, a delivery-side strip length of the rolling mill which corresponds to one rotation of the backup roll, a strip thickness deviation delaying unit for delaying a strip thickness deviation signal of the thickness gauge by a strip transfer time corresponding to a difference between the delivery-side strip length calculated by the strip length calculating unit and a distance of the thickness gauge from the rolling mill, a roll gap control quantity calculating unit for integrating the strip thickness deviation signal delayed by the strip thickness deviation delaying unit at the every same rotational angle of the backup roll which is detected by the rotational angle detecting unit, and calculating each roll gap control quantity of the rolling mill, corresponding to the rotational angle of the backup roll, and a roll gap controller for controlling a roll gap of the rolling mill in accordance with the roll gap control quantity calculated by the roll gap control quantity calculating unit.

According to this strip thickness controller, the strip thickness deviation signal of the thickness gauge is delayed by the strip transfer time corresponding to the difference between the rolling mill delivery-side strip length corresponding to one rotation of the backup roll and the distance of the thickness gauge from the rolling mill. This delayed strip thickness deviation signal is integrated at the every same rotational angle of the backup roll, and the roll gap control quantity of the rolling mill is calculated corresponding to each rotational angle. Hence, even in the rolling mill incapable of performing a kiss-roll, the delivery-side strip thickness deviation due to the eccentricity of the backup roll can be decreased.

A strip thickness controller for a rolling mill according to the present invention comprises a thickness gauge, provided in a position spaced a distance shorter than a circumference of each of backup rolls of the rolling mill on a delivery side of the rolling mill having work rolls and the backup rolls, for detecting a strip thickness deviation from a strip thickness set value, a rotational angle detecting unit for outputting a rotational angle detection signal at every equally-segmented portion when an angle of one rotation of the backup roll is, with "n" being a positive integer, segmented equally by "n", a work roll speed detecting unit for detecting a speed of the work roll of the rolling mill, a strip length calculating/storing unit for calculating, with "j" being an arbitrary integer equal to or smaller than "n", a forward slip of the rolling mill at a point of time when a j-th rotational angle detection signal of the backup roll is outputted from the rotational angle detecting unit, calculating a delivery-side strip speed of the rolling mill on the basis of this forward slip and a speed of the work roll, calculating a j-th delivery-side strip length in the rolling mill on the basis of the strip speed and an elapse time from a (J-1)th rotational angle through the j-th rotational angle of the backup roll, and sequentially storing the delivery-side strip length, a thickness gauge arrival strip detecting unit for integrating the delivery-side strip lengths tracing back to the past form the j-th strip length which are stored in the strip length calculating unit, and detecting such a rotational angle number of the backup roll that the integrated value corresponds to a distance between the rolling mill and the thickness gauge, a strip thickness deviation storing unit, having n-pieces storage areas, for sequentially storing the strip thickness deviation detected by the thickness gauge in the storage area corresponding to the rotational angle of the backup roll, and outputting the previous strip thickness deviation in the storage area which is stored with a delay corresponding to the rotational angle number detected by the thickness gauge arrival strip detecting unit as viewed from the present storage area, a roll gap control quantity calculating unit for integrating the strip thickness deviation signal delayed by the strip thickness deviation delaying unit at the every same rotational angle of the backup roll which is detected by the rotational angle detecting unit, and calculating each roll gap control quantity of the rolling mill, corresponding to the rotational angle of the backup roll, and a roll gap controller for controlling a roll gap of the rolling mill in accordance with the roll gap control quantity calculated by the roll gap control quantity calculating unit.

According to this strip thickness controller, the rolling mill delivery-side strip length is calculated per rotational angle of the backup roll and then stored. These delivery-side strip lengths are integrated tracing back to the past, and there is detected such a rotational angle number of the backup roll that the integrated value corresponds to the distance between the rolling mill and the thickness gauge, and the roll gap control quantity is calculated based on the previous strip thickness deviation in a position of being rolled this time by use of the above rotational angle number. Therefore, the delivery-side strip thickness deviation can be reduced even in the rolling mill incapable of executing the kiss-roll, and in addition, even when the forward slip might change during one rotation of the backup roll, the strip thickness deviation can be modified with a high accuracy.

A strip thickness controller for a rolling mill according to the present invention comprises a thickness gauge, provided in a position spaced a distance shorter than a circumference of each of backup rolls of the rolling mill on a delivery side of the rolling mill having work rolls and the backup rolls, for detecting strip thickness deviation from a strip thickness set value, a rotational angle detecting unit for outputting a rotational angle detection signal at every equally-segmented portion when an angle of one rotation of the backup roll is, with "n" being a positive integer, segmented equally by "n", a strip speed detecting unit for detecting a strip transfer speed on a delivery side of the rolling mill, a strip length calculating/storing unit for calculating, with "j" being an arbitrary integer equal to or smaller than "n", at a point of time when the rotational angle detecting unit outputs the j-th rotational angle detection signal of the backup roll, a j-th delivery-side strip length of the rolling mill on the basis of the strip transfer speed detected by the strip speed detecting unit and an elapse time from a (j-1)th rotational angle through the j-th rotational angle of the backup roll, and sequentially storing the delivery-side strip length, a thickness gauge arrival strip detecting unit for integrating the delivery-side strip lengths tracing back to the pas from the j-th strip length which are stored in the strip length calculating unit, and detecting such a rotational angle number of the backup roll that the integrated value corresponds to a distance between the rolling mill and the thickness gauge, a strip thickness deviation storing unit, having n-pieces storage areas, for sequentially storing the strip thickness deviation detected by the thickness gauge in the storage area corresponding to the rotational angle of the backup roll, and outputting the previous strip thickness deviation in the storage area which is stored with a delay corresponding to the rotational angle number detected by the thickness gauge arrival strip detecting unit as viewed from the present storage area, a roll gap control quantity calculating unit for integrating the strip thickness deviation signal delayed by the strip thickness deviation delaying unit at the every same rotational angle of the backup roll which is detected by the rotational angle detecting unit, and calculating each roll gap control quantity of the rolling mill, corresponding to the rotational angle of the backup roll, and a roll gap controller for controlling a roll gap of the rolling mill in accordance with the roll gap control quantity calculated by the roll gap control quantity calculating unit.

According to this strip thickness controller, the speed of the strip on the delivery side of the rolling mill is detected, and, based on this detected value, the delivery-side strip length is calculated. Hence, even in the rolling mill incapable of performing the kiss-roll, the delivery-side strip thickness deviation can be decreased. In addition, it is feasible to eliminate a necessity for the process of obtaining the forward slip and further enhance the detection accuracy of the strip thickness deviation.

The strip thickness controller of the present invention may further comprise a number-of-rotations detecting unit for detecting the number of rotations of a rolling mill drive motor. The rotational angle detecting unit integrates an output signal of the number-of-rotations detecting unit, and outputs a rotational angle detection signal of the backup roll each time an integrated value thereof reaches a predetermined value.

According to this strip thickness controller, the rotational angle of the backup roll is detected by integrating the output signal of the number-of-rotations detecting unit normally used for the rolling control, thereby eliminating a necessity for adding a new element for detecting the rotation.

The strip thickness controller of the present invention may further comprise a first pulse generating unit for generating one single pulse each time the backup roll makes one rotation, and a second pulse generating unit for generating, with "m" being an integer equal to or larger than "n", m-pieces of pulses each time the backup roll makes one rotation. The rotational angle detecting unit outputs n-pieces of rotational angle detection signals of the backup roll by use of the m-pieces of pulse signals generated from the second pulse generating unit on the basis of a point of time when the first pulse generating unit generates the pulse.

According to this strip thickness controller, the rotational angle of the backup roll is detected by use of the pulse signal of the second pulse generating unit on the basis of the point of time when the first pulse generating unit generates the pulse, so that the detection accuracy thereof is enhanced and the detection can be facilitated.

The strip thickness controller of the present invention may further comprise a number-of-rotations detecting unit for detecting the number of rotations of a rolling mill drive motor, and a pulse generating unit for generating one single pulse each time the backup roll makes one rotation. The rotational angle detecting unit integrates, on the basis of a point of time when the pules generating unit generates the pulse, an output signal of the number-of-rotations detecting unit, and outputs a rotational angle detection signal of the backup roll each time an integrated value thereof reaches a predetermined value.

According to this strip thickness controller, the rotational angle of the backup roll can be detected with the high accuracy simply by providing the pulse generating unit in addition to the number-of-rotations detecting unit of the rolling mill, which is normally used for the rolling control.

To accomplish the above object of the present invention, according to a second aspect of the invention, a strip thickness controller for a rolling mill comprises a thickness gauge, provided on a delivery side of the rolling mill including work rolls and backup rolls, for detecting a strip thickness deviation from a strip thickness set value, a pulse generating unit for generating a pulse at every predetermined rotational angle of the backup roll, a strip speed detecting unit for detecting strip speed on the delivery side of the rolling mill, a rotating time calculating unit for calculating, when n>1, an n-rotations time of the backup roll on the basis of an output of the pulse generating unit, a tracking unit for delaying an output of the thickness gauge by a strip transfer time corresponding to a difference between a strip transfer distance corresponding to n-rotations of the backup roll and a distance of the thickness gauge from the rolling mill, a repetitive control calculating means for making a repetitive control calculation of a strip thickness deviation, as a control quantity, in previous n-rotations of the backup roll which is outputted from the tracking unit, a unit for calculating a roll gap compensation quantity from an output of the repetitive control calculating unit, and a roll gap controller for controlling a roll gap of the rolling mill in accordance with the roll gap compensation quantity.

According to this strip thickness controller also, the delivery-side strip thickness deviation due to the eccentricity of the backup roll can be reduced even in the rolling mill unable to perform the kiss-roll.

Further, a strip thickness controller for a rolling mill comprises a thickness gauge, provided on a delivery side of the rolling mill including work rolls and backup rolls, for detecting a strip thickness deviation from a strip thickness set value, a pulse generating unit for generating a pulse at every predetermined rotational angle of the backup roll, a strip speed detecting unit for detecting strip speed on the delivery side of the rolling mill, a rotating time calculating unit for calculating a one-rotation time of the backup roll on the basis of the pules outputted from the pulse generating unit, a tracking unit for delaying an output of the thickness gauge by a strip transfer time corresponding to a difference between a strip transfer distance corresponding to one-rotation of the backup roll and a distance of the thickness gauge from the rolling mill, a repetitive control calculating unit for making a repetitive control calculation of a strip thickness deviation, as a control quantity, in previous one-rotation of the backup roll which is outputted from the tracking unit, a unit for calculating a roll gap compensation quantity from an output of the repetitive control calculating unit, and a roll gap controller for controlling a roll gap of the rolling mill in accordance with the roll gap compensation quantity.

According to this strip thickness controller also, the delivery-side strip thickness deviation attributed to the eccentricity of the backup roll can be reduced even in the rolling mill incapable of effecting the kiss-roll.

The output of the repetitive control calculating unit may be compensated by an auto strip thickness control unit using a gauge meter strip thickness system.

According to this strip thickness controller, it is possible to decrease an influence of the roll eccentricity upon the delivery-side strip thickness even under the strip thickness control using the gauge meter strip thickness system.

The rotation time calculating unit may calculate a one-rotation of n-rotations time of the backup roll from the output pulse from the pulse generating unit and a roll diameter ratio of the backup roll with respect to the work roll. With this contrivance, the delivery-side strip thickness deviation due to the eccentricity of the backup roll can be decreased even in the rolling mill incapable of detecting the rotational angle of the backup roll.

The rotation time calculating unit includes rotational angle learning unit for learning and compensating the backup roll rotational angle calculated from the one-rotation time of the backup roll.

With this contrivance, even in the rolling mill incapable of detecting the rotational angle of the backup roll, if able to detect the one-rotation time of the backup roll, the accuracy of the rotational angle can be enhanced by using this one-rotation time.

The strip thickness controller of the present invention may further comprise a rolling force detecting unit for detecting a rolling force, and an eccentricity cycle extracting unit for extracting a one-rotation time of the backup roll on the basis of the rolling force detected by the rolling force detecting unit. The rotation time calculating unit may be constructed to learn the rotational angle of the backup roll by use of the one-rotation time extracted by the eccentricity cycle extracting unit. With this contrivance, even in the rolling mill incapable of detecting the rotational angle of the backup roll, if able to calculate the one-rotation time of the backup roll from a fluctuation cycle of the rolling force, the accuracy of the rotational angle can be enhanced by using it.

The repetitive control calculating unit may include a filter unit for cutting a high-frequency component of the input signal.

With this configuration, the error in the rotational angle of the backup roll can be rounded by using the low-pass filter, and therefore the roll eccentricity eliminating accuracy can be enhanced.

A strip speed on the delivery side of the rolling mill is calculated from the forward slip of the rolling mill and from the work roll rotational angle obtained from the pulse generating unit. With this contrivance, even when incapable of directly detecting the speed of the strip, it is feasible to decrease the delivery-side strip thickness deviation derived from the eccentricity of the backup roll.

The thickness gauge may include a filter unit, disposed at an output stage thereof, for cutting a high-frequency component contained in the input signal. With this configuration, the error in the transfer time can be rounded by use of the low-pass filter, and hence the roll eccentricity eliminating accuracy can be enhanced.

The repetitive control calculating unit may include a de-memorizing unit for de-memorizing a part of the signals stored. Since the outputs of the repetitive control can be de-memorized, a control accuracy after inputting the abnormal value can be increased.

DESCRIPTION OF THE PREFERRED EMBODIMENTS

The present invention will hereinafter be discussed in depth by way of preferred embodiments illustrated in the accompanying drawings.

Figure 1:
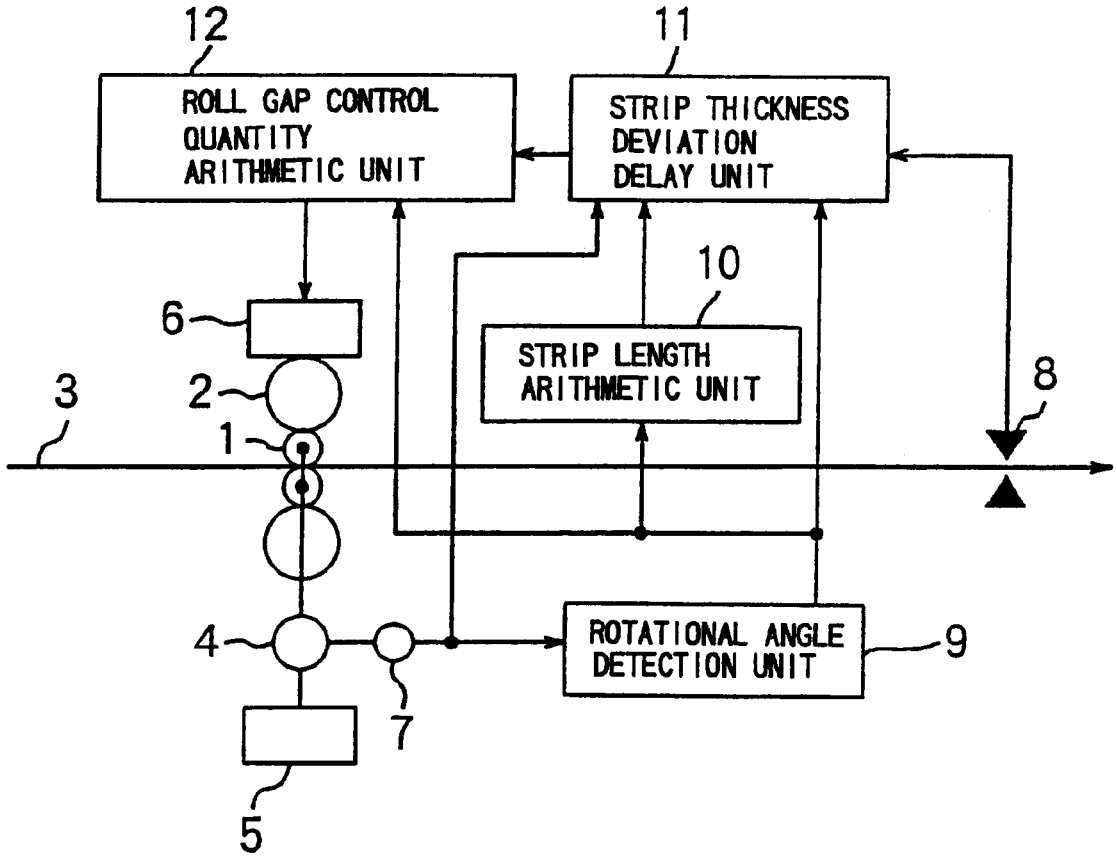
FIG. 1 is a block diagram showing, in combination of a rolling system, a construction of a first embodiment of a strip thickness controller for a rolling mill according to the present invention.

FIG. 1 is a block diagram showing a construction of a first embodiment of the present invention in combination with a rolling system. Referring to FIG. 1, backup rolls 2 are disposed respectively above and under a pair of work rolls 1, thus constituting a rolling mill. A strip 3 is rolled by this rolling mill. A rolling mill drive motor 4 is linked to the work rolls 1 and controlled to a predetermined rotating speed by a speed controller (ASR) 5. Further, a roll gap controller 6 is provided for controlling a roll gap of the rolling mill.

A pulse generator 7, which generates pulses corresponding to rotations thereof and is utilizable for detecting a rotational speed of the work roll, is connected to the rolling mill drive motor 4. Moreover, on the delivery side of the rolling mill, a thickness gauge 8 capable of detecting strip thickness deviation from a set value, is provided in a position spaced a distance shorter than a circumferential length of the backup roll 2 as viewed from the rolling mill. A rotational angle detection unit 9 is connected to the pulse generator 7. The rotational angle detection unit 9 inputs a pulse signal transmitted from the pulse generator 7, and outputs a detection signal of a rotational angle at every equally-segmented portion when an angle of one rotation of the backup roll 2 is segmented equally by n, where n is a positive integer. A strip length arithmetic unit 10 calculates a forward slip at a point of time when the rotational angle detection signal is outputted from the rotational angle detection unit 9, and, based on this forward slip and a radius of the backup roll 2, calculates a delivery-side strip length in the rolling mill which corresponds to one rotation of the backup roll 2.

A strip thickness deviation delay unit 11, just when the rotational angle detection signal is outputted from the rotational angle detection unit 9, delays a strip thickness deviation signal detected by the thickness gauge 8 by a strip shift time corresponding to a difference between the delivery-side strip length calculated by the strip length arithmetic unit 10 and the distance of spacing of the thickness gauge 8 from the rolling mill, and adds the delayed signal to a roll gap controller 12. The roll gap controller 12, calculates a roll gap control quantity of the rolling mill which corresponds to the rotational angle of the backup roll 2 by integrating the thickness deviation signal added to the controller 12 itself through the every same rotational angle at a point of time when the rotational angle detection signal of the backup roll 2 is outputted, and adds this quantity to the roll gap controller 6.

An operation of the first embodiment having the construction described above will hereinafter be explained referring to FIGS. 2 through 4.

In the first embodiment, with an emphasis that a large proportion of a roll eccentricity synchronizes with the rotations of the backup roll 2, the thickness gauge 8 provided on the delivery side of the rolling mill detects a delivery-side strip thickness deviation corresponding to the rotational angle of the backup roll 2, and the strip thickness deviation is reduced by controlling a roll gap of the rolling mill by use of a delivery-side strip thickness deviation signal.

In this case, the thickness gauge 8 is disposed in the position where the distance from the rolling mill becomes shorter than the circumferential length of the backup roll 2, and hence, before an end of one rotation of the backup roll 2, the delivery-side strip thickness deviation corresponding to the rotational angle of the backup roll 2 can be detected. This thickness deviation is used for calculating the roll gap control quantity, thereby making it feasible to correspond to a case of the roll eccentric state might change in the process of being rolled.

To be specific, an angle of 360 degrees through one rotation of the backup roll 2 is segmented equally by "n", and a delivery-side strip thickness deviation corresponding to each of n-pieces of equally-segmented portions is detected. Further, a roll gap control quantity with respect to the rotational angle thereof is calculated by use of the strip thickness deviation corresponding to a rotational angle of each of the equally-segmented portions, and a roll gap is controlled based on this control quantity. Herein, supposing that, for example, n=180, it follows that the roll gap is controlled at an interval of 2 degrees.

Figure 2A:
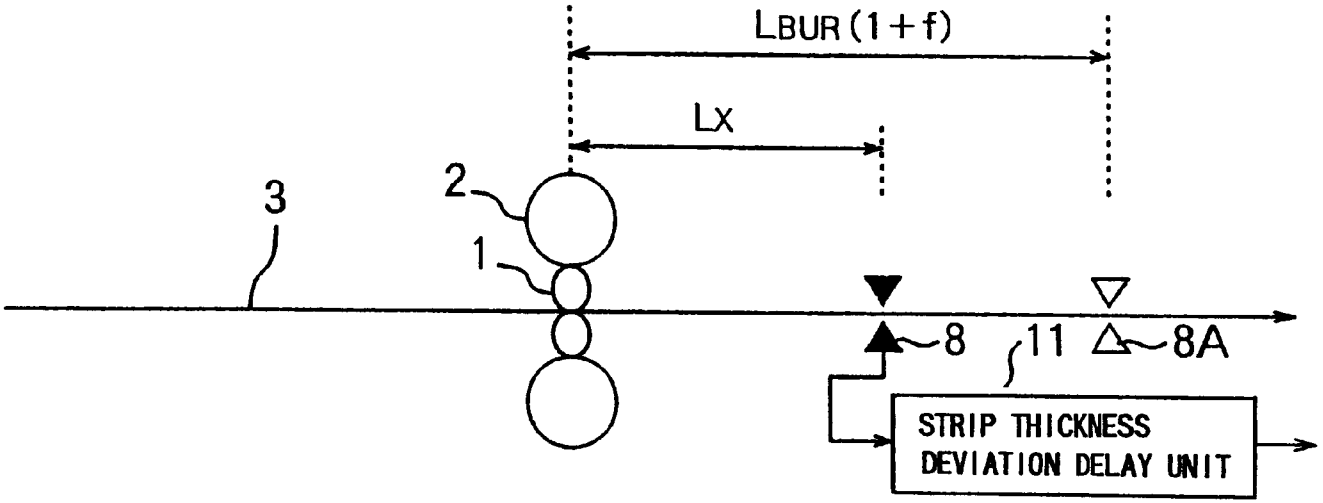
FIGS. 2A and 2B are an explanatory view, showing a relationship between a position of installing a thickness gauge and a strip thickness deviation due to a roll eccentricity, for assistance of explaining an operation in the first embodiment illustrated in FIG. 1.

Now, as shown in FIG. 2A, L is assumed to be the distance of the thickness gauge 8 from the rolling mill. On the other hand, let $R_{BUR}$ be the radius of the backup roll 2, and a circumference $L_{BUR}$ of the backup roll 2 is expressed by the following formula:

$$L_{BUR}=2 \cdot \pi \cdot R_{BUR} \quad (1)$$

In accordance with the first embodiment, the thickness gauge 8 is disposed to establish a relationship between the distance L and the circumference $L_{BUR}$ which is given by the following formula:

$$L<L_{BUR} \quad (2)$$

Further, it is presumed in the first embodiment as if an imaginary thickness gauge 8A exists in a position spaced away by the delivery-side strip length corresponding to one rotation of the backup roll 2 as viewed from the rolling mill, i.e., a position spaced a distance given by $L_{BUR}$ (1+f) where f is the forward slip. More specifically, the strip thickness deviation signal detected by the thickness gauge 8 is delayed by a time for which the strip 3 shifts a distance $\{L_{BUR}(1+f)-L_X\}$ by the strip thickness deviation delay unit 11. An output signal of this strip thickness deviation delay unit 11 is conceived as an output signal of the imaginary thickness gauge 8A.

Figure 2B:
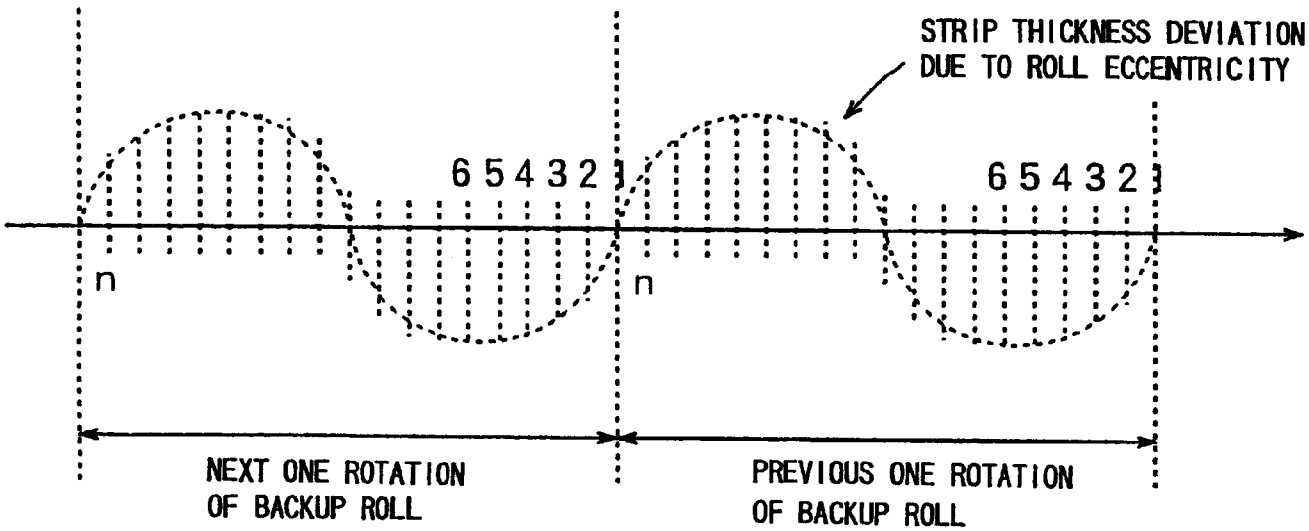

FIG. 2B shows a strip thickness deviation based on the roll eccentricity for one rotation of the backup roll 2 which has already been rolled, and a strip thickness deviation based on the roll eccentricity for one rotation of the backup roll 2 which might, it is predicted, occur in the strip to be rolled hereinafter. As described above, the distance of the imaginary thickness gauge 8A from the rolling mill is equal to the deliver-side strip length corresponding to one rotation of the backup roll 2, and therefore the output signal of the strip thickness deviation delay unit 11 assuming the illustrated state, turns out a strip thickness deviation signal corresponding to a first rotational angle of previous one rotation of the backup roll 2.

With a further progress of rolling thereafter, an output of the strip thickness deviation delay unit 11 is fetched in every position through the rotational angle of the backup roll 2 that corresponds to a position in which to generate the detection signal of each of the second to n-th rotational angles, thereby obtaining a strip thickness deviation signal of the rotational angle of previous one rotation, which is equal to the rotational angle of the backup roll 2 in a state of being rolled at the present.

The pulse generator 7 shown in FIG. 1 in the first embodiment outputs a pulse signal corresponding to a rotation of the rolling mill drive motor 4. In this instance, let NM be a pulse output value of the pulse generator 7, and a rotational angle Δθ is given by the following formula:

$$\Delta\theta = \int N_M(t) \cdot \eta \cdot \frac{R_{WR}}{R_{BUR}} dt \quad (3)$$

A point of time when the angle Δθ in this formula (3) becomes equal to an angle $\Delta\theta_A$ through which 360 degrees of one rotation of the backup roll are segmented equally by "n", is a point of time of reaching the next rotational angle, and a rotational angle number j may be incremented by 1.

Figure 3:
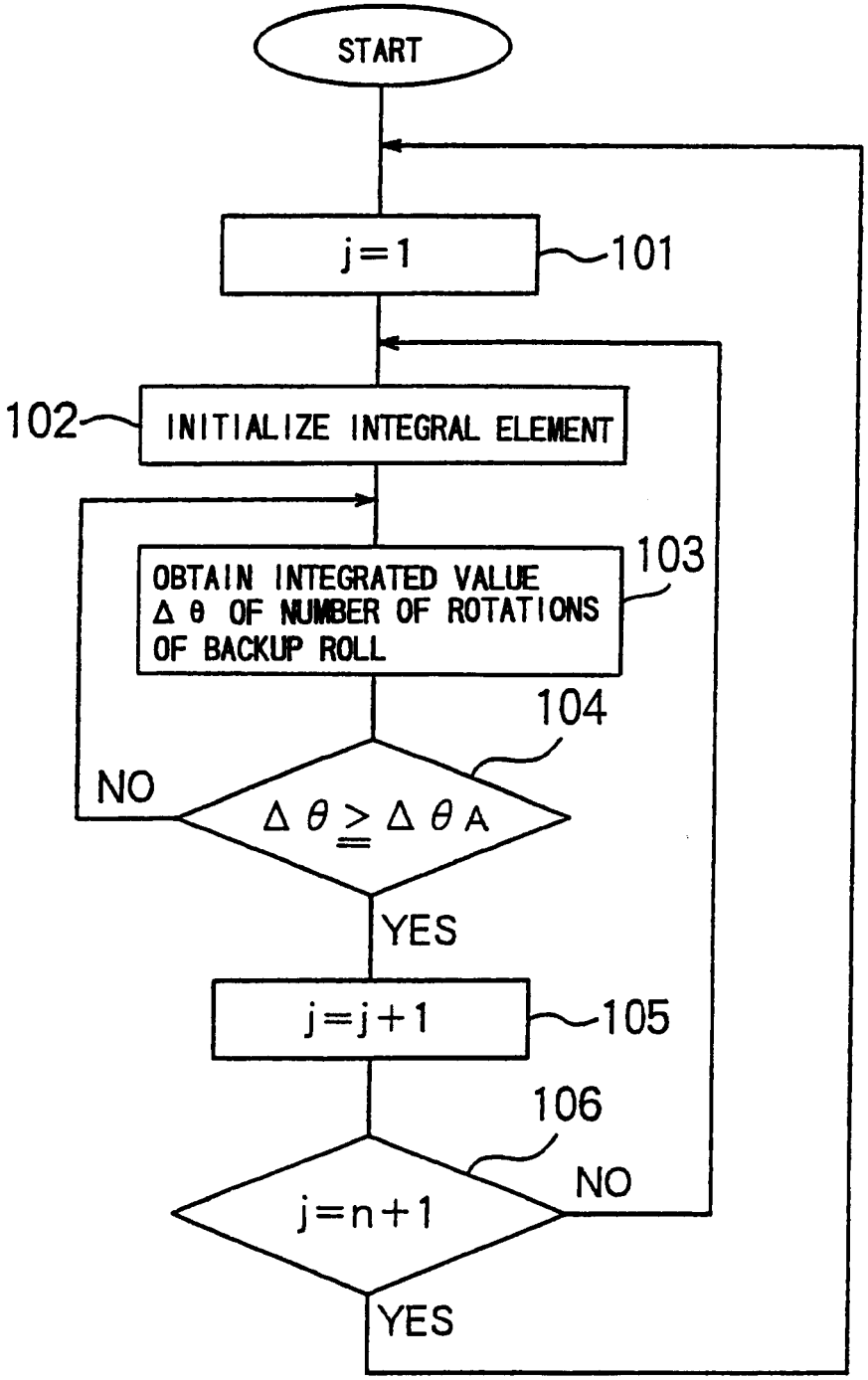
FIG. 3 is a flowchart showing a processing procedure of a rotational angle detection unit as a component of the construction of the first embodiment illustrated in FIG. 1.

FIG. 3 is a flowchart showing a processing procedure of the rotational angle detection unit 9. That is, the rotational angle number j is set to 1 in step 101, thus obtaining a first rotational angel detection signal. Next, an integral element in the formula (3) is initialized in step 102, and an integration (count of pulses) of the rotational angle of the backup roll is executed in step 103. It is judged in step 104 whether or not the integrated value Δθ thereof reaches the angular value $\Delta\theta_A$ through which to equally segment the angle of one rotation of the backup roll by "n". If reaching this value, the rotational angle number j is incremented by 1 in step 105, thus obtaining a second rotational angle detection signal. Subsequently, it is judged in step 106 whether or not the rotational angle number j comes to a preset value given by n+1. If this value is not yet reached, a loop of the processes from step 102 onward are repeated. Whereas if reached, the operation proceeds to the processes subsequent to step 101. With those processes having thus been executed, n-pieces of rotational angle detection signals are obtained during one rotation of the backup roll 2.

These rotational angle detection signals are added to the strip length arithmetic unit 10, the strip thickness deviation delay unit 11 and the roll gap control quantity arithmetic unit 12. The strip length arithmetic unit 10, when the first rotational angle detection signal is outputted from the rotational angle detection unit 9, calculates the forward slip "f" in a known rolling model formula. The delivery-side strip length $L_{BUR}$(1+f) corresponding to one rotation of the backup roll 2 is calculated by use of this forward slip "f" and the circumference $L_{BUR}$ of the backup roll 2 which has been given by the formula (1), and is added to the strip thickness deviation delay unit 11. Then, the strip thickness deviation delay unit 11 calculates a distance $\{L_{BUR}(1+f) - L_X\}$ between the thickness gauge 8 and the imaginary thickness gauge 8A, subsequently calculates a time for which the strip is transferred this distance by use of the output signal of the pulse generator 7, and delays it by this period of time. Then, a strip thickness deviation signal of the thickness gauge 8 is added to the roll gap control quantity arithmetic unit 12.

Figure 4:
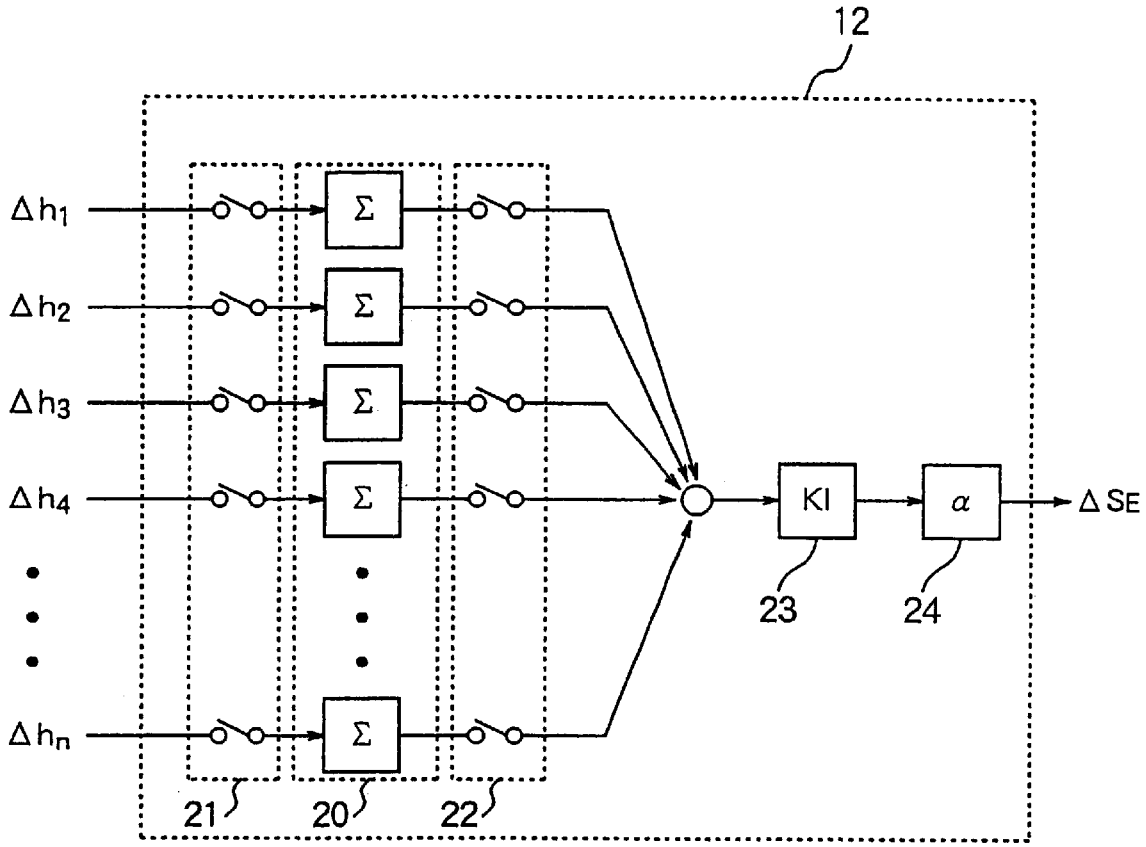
FIG. 4 is a block diagram for assistance of explaining a function of a roll gap control quantity calculating unit as a component of the construction of the first embodiment shown in FIG. 1.

FIG. 4 is a block diagram showing a function of the roll gap control quantity arithmetic unit 12. The roll gap control quantity arithmetic unit 12 is constructed of totally n-pieces of samplers 21 for sequentially sampling n-pieces of strip thickness deviation signals $\Delta h_1 - \Delta h_n$ obtained by equally segmenting the angle of one rotation of the backup roll 2 in accordance with the angle detection signals transmitted from the rotational angle detection unit 9, n-pieces of integrators 20 for integrating sample signals obtained through these samplers, totally n-pieces of samplers 22 for sequentially sampling outputs of the individual integrators in accordance with the angle detection signals given from the rotational angle detection unit 9, a conversion coefficient setting unit 23 for inputting the outputs of the integrators which have been obtained via those respective samplers and converting these outputs into roll gap signals, and an adjusting gain setting unit 24 for a roll gap control quantity $\Delta S_E$ obtained by multiplying the converted roll gap signal by an adjusting gain α.

Herein, the samplers 21, 22 connected to the same integrator are controlled ON/OFF by the 1-th (1=1~n) rotational angle detection signal outputted from the rotational angle detection unit 9, synchronizing with each other. Each of the integrators integrates a strip thickness deviation signal of this time with an integrated value of the strip thickness deviation signals given before the last time, and outputs a result of this integration. The conversion coefficient setting unit 23 multiplies this output by a conversion coefficient KI and outputs a result of this multiplication. The conversion coefficient KI is given by the following formula:

$$KI = -\frac{M+Q}{M} \quad (4)$$

where M is the elastic coefficient of the rolling mill, and Q is the plasticity coefficient of the strip.

A roll gap obtained by the multiplication of this conversion coefficient KI, is further multiplied by the adjusting gain $\alpha$ of the adjusting gain setting unit 24, thereby acquiring the roll gap control quantity $S_E$. The adjusting gain $\alpha$ is, however, normally set to 0.3–0.5 in terms of considering a stability of the control system.

In the way described above, as a result of controlling the roll gap with respect to the strip thickness deviation at the 1-th (i=1 –n) through one rotation of the backup roll 2, even it there is a strip thickness deviation during next one rotation, a value of this deviation is further integrated by the integrator 20, thus modifying the roll gap control quantity. The strip thickness deviation is therefore sequentially reduced.

Thus, according to the first embodiment, in the rolling mill also which does not easily permit a kiss-roll, it is feasible to decrease the delivery-side strip thickness deviation due to the eccentricity of the backup roll.

Figure 5:
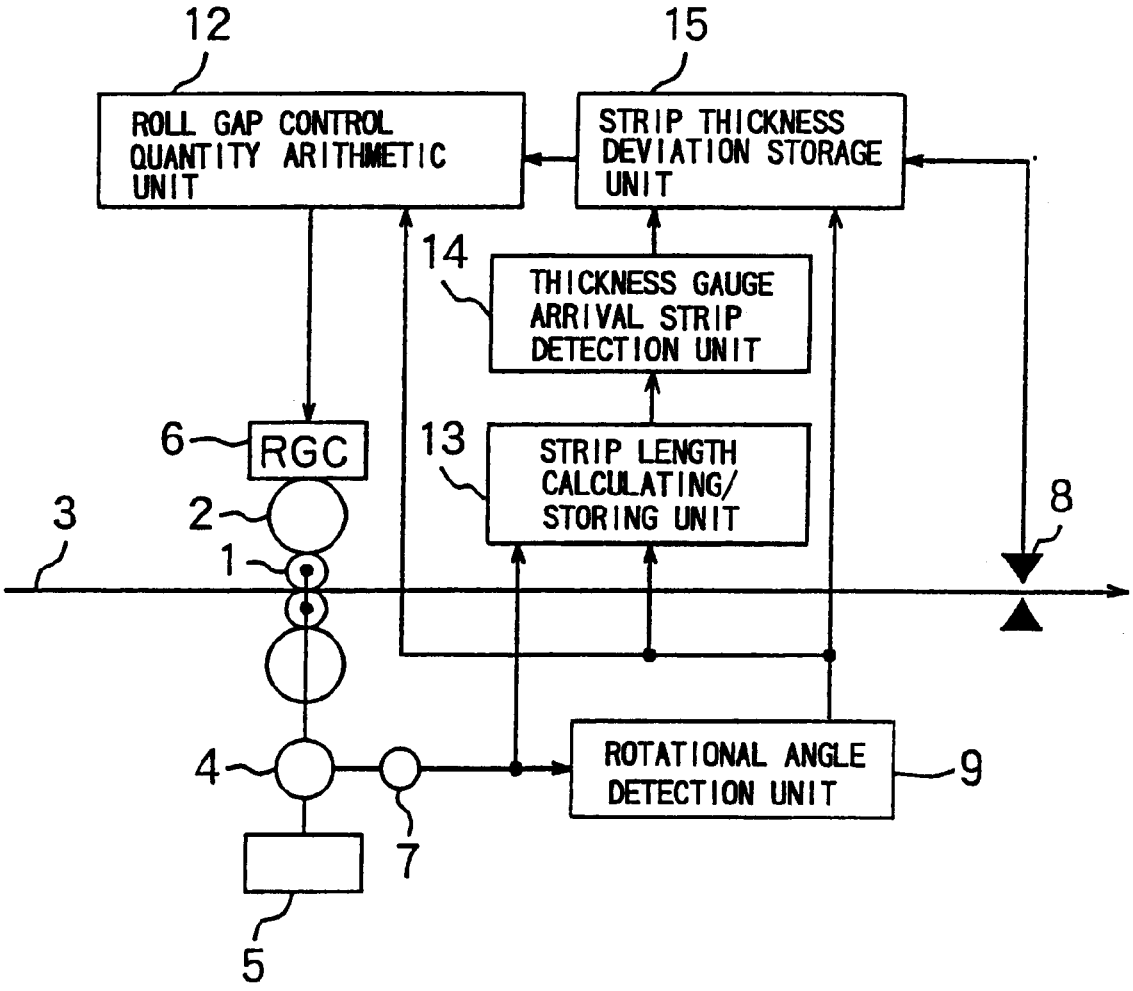
FIG. 5 is a block diagram showing, in combination of the rolling system, a construction of a second embodiment of the strip thickness controller for the rolling mill according to the present invention.

FIG. 5 is a block diagram showing a construction of a second embodiment of the strip thickness controller for the rolling mill according to the present invention. Referring to FIG. 5, the same components as those in FIG. 1 are marked with the identical numerals, of which the repetitive explanations are omitted. A scheme in the second embodiment is that even if the forward slip might change for the duration of one rotation of the backup roll 2 due to a change in speed of the rolling mill drive motor 4 and so on, the strip thickness deviation is to be modified with a high accuracy. For attaining this, a strip length calculating/storing unit 13, every time the rotational angle detection unit 9 outputs the rotational angle detection signal, sequentially calculates and stores the delivery-side strip length till the rotational angle detection signal is outputted this time since the rotational angle detection signal has been outputted last time. A thickness gauge arrival strip detection unit 14 is connected to the strip length calculating/storing unit 13. The thickness gauge arrival strip detection unit 14 adds the delivery-side strip length in the process of being rolled at the present in sequence tracing back to the past, then detects such a delivery-side strip length that the added value becomes a distance Lx between the rolling mill and the thickness gauge 8, i.e., a value by which to divide the rotational angle of the backup roll 2, and adds this detected value to the strip thickness deviation storage unit 15. The strip thickness deviation storage unit 15 is constructed to have memory areas each corresponding to a unit rotational angle when the angle of one rotation of the backup roll 2 is segmented equally by "n". Each time the rotational angle detection unit 9 outputs the rotational angle detection signal, the strip thickness deviation is updated and stored in the storage area corresponding thereto. Then, the strip thickness deviations, of which the number corresponds to the number of segmented rotational angles which has been detected by the thickness gauge arrival strip detection unit 14, in previous one rotation in the area that should be afterwards stored with the updated deviation, are outputted and added to the roll gap control quantity arithmetic unit 12.

Hereinafter, an operation of the second embodiment will be described, and the discussion will entail the reference to FIG. 6 and be focused particularly on differences from the embodiment illustrated in FIG. 1.

The pulse generator 7 outputs the pulse signals corresponding to the rotations of the rolling mill drive motor 4, and supplies the pulse signals to the rotational angle detection unit 9 and the strip length calculating/storing unit 13. The rotational angle detection unit 9 counts the number of pulses given from the pulse generator 7, and outputs one through n-pieces of rotational angle signals whenever a rotational position of the backup roll 2 deviates by the equally-segmented angle. The strip length calculating/storing unit 13 calculates in the following formula a delivery-side strip length Lj corresponding to a span of movement from, e.g., a (j-1)th rotational angle to a j-th rotational angle among those angles.

$$Lj = N_M \cdot \eta \cdot \frac{R_{WR}}{R_{BUR}} \cdot 2\pi \cdot R_{BUR} \cdot \Delta tj \cdot (1 + fj) \tag{5}$$

where Lj is a j-th delivery-side strip length, $N_M$ is a pulse output, $\eta$ is a gear ratio, $R_{WR}$ is a radius of a work roll, $R_{BUR}$ is a radius of the backup roll, $\Delta$tj is a time of a strip movement from the (j-1)th rotational angle to the j-th rotational angle, and fj is a forward slip at the j-th rotational angle when rolled. In this case, the forward slip fj can be easily calculated by use of a known rolling theoretical formula.

This strip length calculating/storing unit 13 has storage areas for storing the delivery-side strip lengths in sequence, and incorporates a function of sequentially updating and storing the latest delivery-side strip length.

Figures 6A, 6B, 6C:
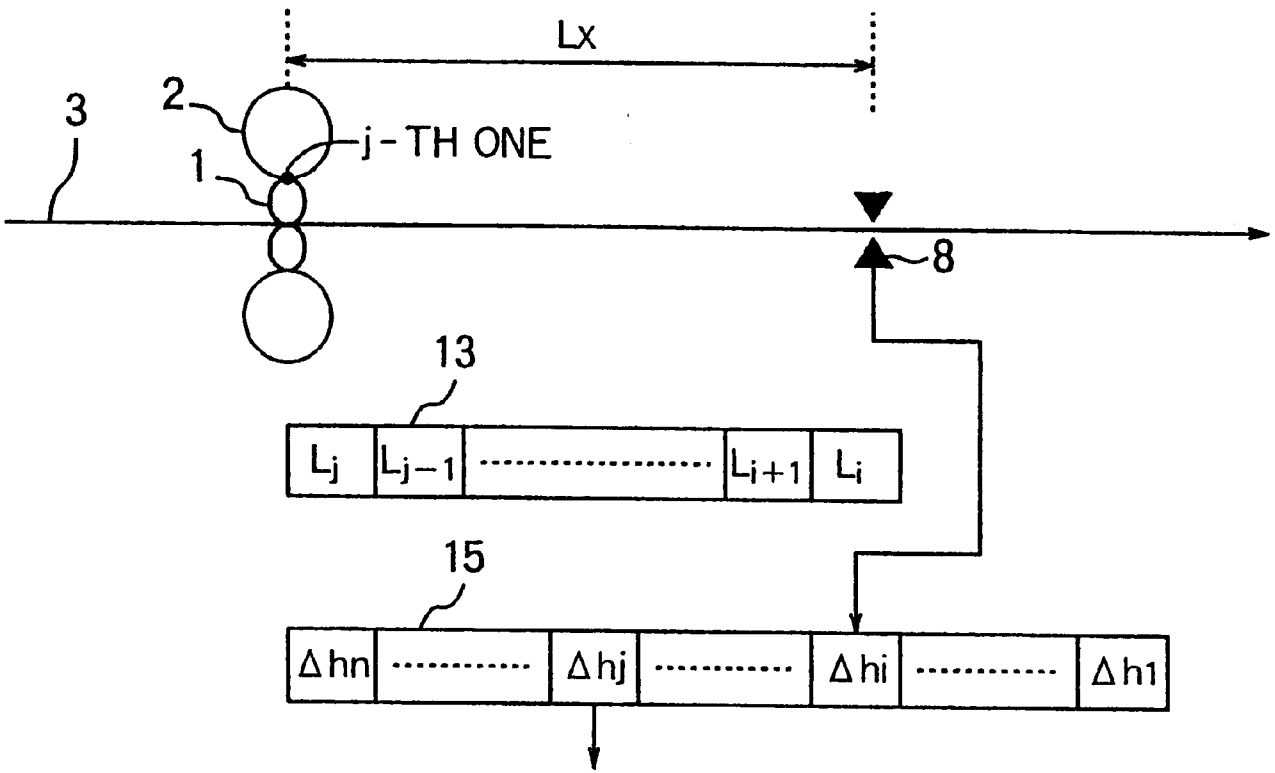
FIGS. 6A–6C are an explanatory view, showing a relationship between the position of installing the thickness gauge and a storage area of a storage unit, for assistance of explaining an operation in the second embodiment illustrated in FIG. 5.

FIGS. 6A–6C are explanatory diagrams showing a position where the thickness gauge 8 is disposed with respect to the rolling mill, and showing a relationship between the strip length calculating/storing unit 13 and the strip thickness deviation storage unit 15. Herein, the thickness gauge 8 is spaced the distance Lx away from the rolling mill. The strip length calculating/storing unit 13 has storage areas, of which a sufficient number may be "n" at the maximum, for storing the delivery-side strip lengths calculated at the respective rotational angles (1~n) of the backup roll 2. The strip thickness deviation storage unit 15 has n-pieces of storage areas for storing strip thickness deviations $\Delta h_1$–$\Delta h_n$ detected respectively at the rotational angles (1–n) of the backup roll 2.

Herein, the strip length calculating/storing unit 13, each time the detection signal of the rotational angle is given, shifts the data stored in each storage area rightward on the drawing, and repeats an operation of storing a latest delivery-side strip length Lj in the storage area provided at the left end on the drawing. Accordingly, a delivery-side strip length Li at right end on the drawing may be conceived as oldest among those tracing back to the past. On the other hand, the strip thickness deviation storage unit 15 updates and stores the strip thickness deviation $\Delta h_1$ at the first rotational angle in the equally-divided position of the backup roll 2 in the storage area at the right end on the drawing, and stores the strip thickness deviation $\Delta h_n$ at the n-th rotational angle in the storage area at the left end on the drawing.

The thickness gauge arrival strip detection unit 14 adds the delivery-side strip length stored in the strip length calculating/storing unit 13, tracing from the j-th length back to the past. When the added value is equal to the distance Lx between the rolling mill and the thickness gauge 8 or just over $L_X$, the thickness gauge arrival strip detection unit 14 supplies the added value of the delivery-side strip lengths, i.e., the number of segmented rotational angles to the strip thickness storage unit 15. Referring to FIG. 6, the i-th value is the last added value. In this case, the i-th strip thickness deviation $\Delta h_i$ is updated and stored in the strip thickness deviation storage unit 15, and, as viewed from this storage area, the area on the left side on the drawing is stored with the strip thickness deviation of the last time. The strip thickness deviation storage unit 15, as viewed from the i-th storage area, extracts the strip thickness deviation $\Delta h_i$ in the storage area which deviates by the number of additions of the delivery-side strip lengths calculated by the thickness gauge arrival strip detection unit 14, and supplies this deviation to the roll gap control quantity arithmetic unit 12. In the roll gap control quantity arithmetic unit 12, this strip thickness deviation $\Delta h_i$ is inputted to a j-th adder. Hereinafter, as explained referring to FIG. 4, the roll gap control quantity $\Delta S_E$ is calculated, thereby controlling the roll gap.

Thus, according to the second embodiment illustrated in FIGS. 5 and 6, the delivery-side strip length up to the thickness gauge 8 is obtained by estimating the forward slip at every rotational angle, and hence the strip thickness can be modified with the high accuracy even when the forward slip might change during one single rotation of the backup roll 2 due to the change in speed of the rolling mill drive motor 4.

Figure 7:
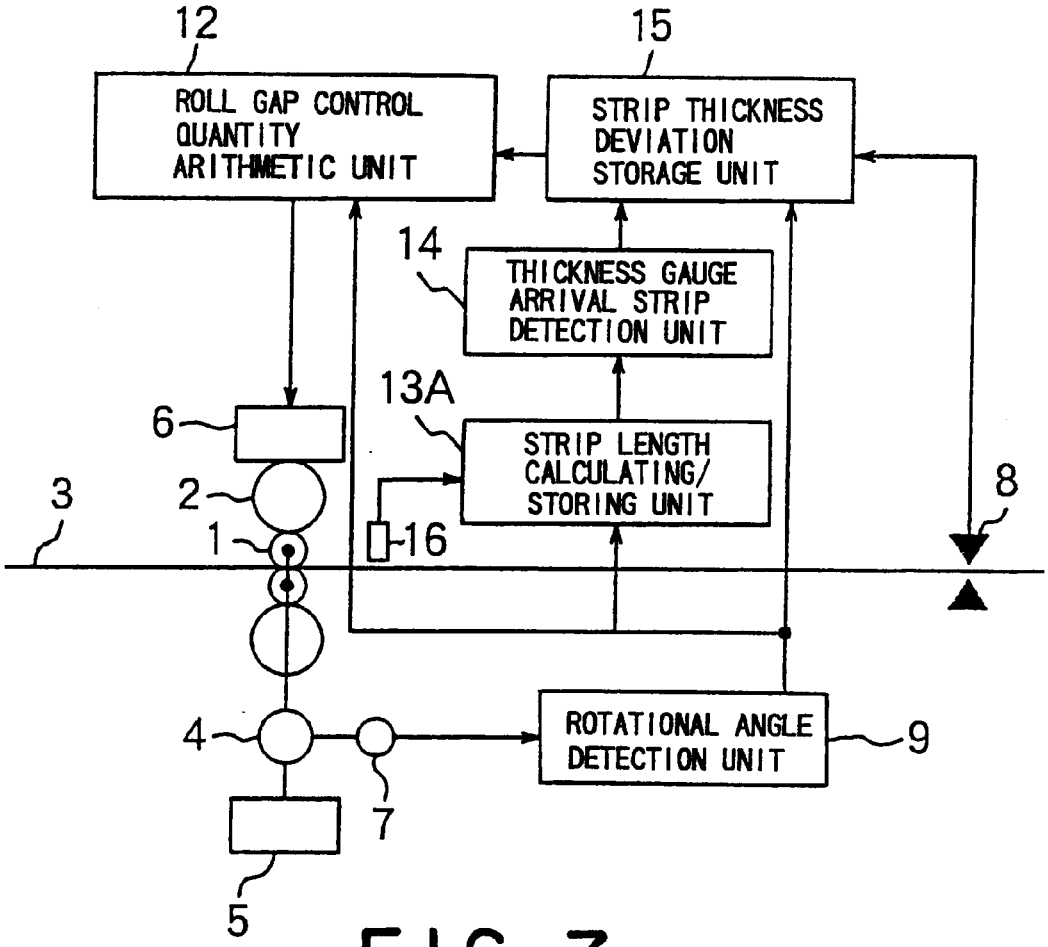
FIG. 7 is a block diagram showing, in combination of the rolling system, a construction of a third embodiment of the strip thickness controller for the rolling mill according to the present invention.

FIG. 7 is a block diagram showing a construction of a third embodiment of the strip thickness controller for the rolling mill according to the present invention. Referring to FIG. 7, the same components as those in FIG. 5 are marked with the identical numerals, of which the repetitive explanations are omitted. A different point of the third embodiment from the construction shown in FIG. 5 is that a strip spaced meter 16 for detecting a speed of the strip 3 on the delivery side of the rolling mill is newly provided, and a strip length calculating/storing unit 13A, based on a value of speed detected by this strip speed meter 16, sequentially calculates the delivery-side strip lengths till the rotational angle detection signal is outputted this time since the rotational angle detection signal has been outputted last time. Accordingly, the output signal of the pulse generator 7 is transmitted not to the strip length calculator/storing unit 13A but to only the rotational angle detection unit 9.

It is herein assumed that the strip speed meter 16 outputs an actual value Voj of the transfer speed of the strip 3 at, e.g., the j-th rotational speed angle of the backup roll 2. At this time, the strip length calculating/storing unit 13A calculates a delivery-side strip length Lj in the following formula by use an output time interval $\Delta tj$ of the rotational angle detection signal outputted from the rotational angle detection unit 9.

$$Lj=Voj\cdot\Delta tj \tag{6}$$

Then, the strip length calculating/storing unit 13A stores this delivery-side strip length Lj in each storage area shown in FIG. 6B.

That is, in the second embodiment illustrated in FIG. 5, the strip length calculating/storing unit 13 obtains the deliver side strip length Lj based on the formula (5). By contrast, in the third embodiment shown in FIG. 7, the delivery-side strip length Lj is obtained based on the formula (6) by use of an actual value Voj of the strip speed detected by the strip speed meter 16. With this contrivance, even if the forward slip might change during one rotation of the backup roll 2, a necessity for the operation of obtaining the forward slip is eliminated, and simultaneously the delivery-side strip length based on the actual value of the strip speed is calculated. Therefore, the detection accuracy of the strip thickness deviation can be further enhanced.

Figure 8:
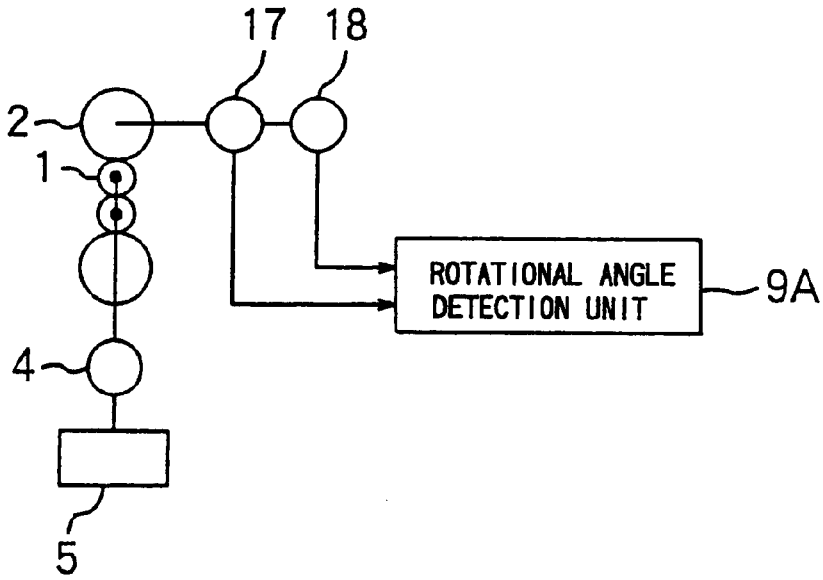
FIG. 8 is a block diagram showing, in combination of the rolling system, a construction of a fourth embodiment of the strip thickness controller for the rolling mill according to the present invention.

FIG. 8 is a diagram showing a part of construction of a fourth embodiment of the strip thickness controller for the rolling mill according to the present invention. In the first through third embodiments discussed above, the rotational angle detection unit 9 detects the rotational angle of the backup roll 2 on the basis of the output of the pulse generator 7 connected on the rolling mill drive motor 4. In the fourth embodiment, however, two pieces of pulse generators 17, 18 are connected directly to the backup roll 2, and a rotational angle detection unit 9A outputs the rotational angle detection signal of the backup roll 2 on the basis of outputs of those pulse generators.

Figures 9A, 9B, 9C:
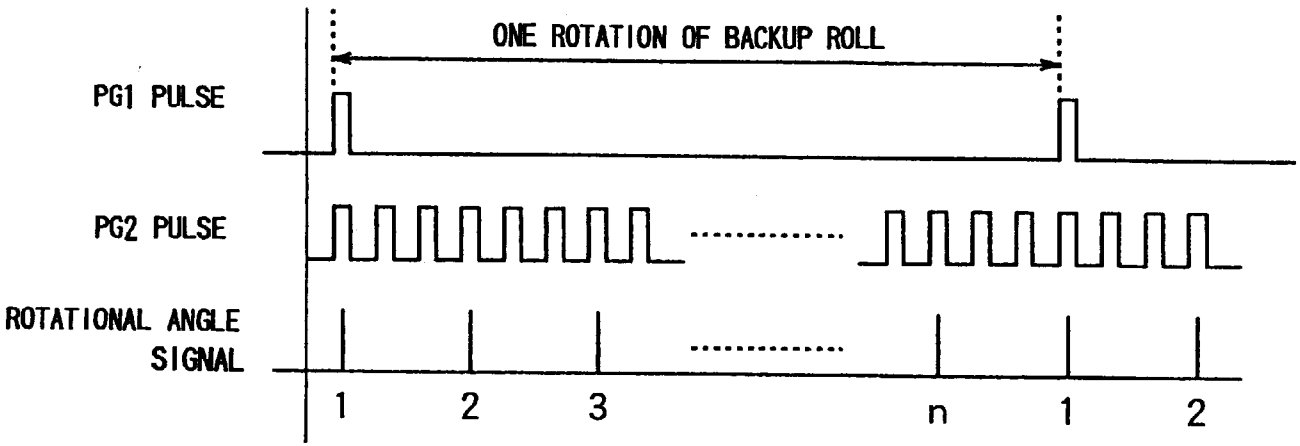
FIGS. 9A–9C are graphs showing a relationship between an output pulse of a pulse generator and an output pulse of a rotational angle detection unit, for assistance of explaining an operation in the fourth embodiment shown in FIG. 8.

Herein, the pulse generator 17 generates one single pulse each time the backup roll 2 makes one rotation. The pulse generator 18 generates m-pieces of pulses (where "m" is given by multiplying an integer by "n" such as m=k·n; k is an integer) per rotation of the backup roll 2. On the other hand, the rotational angle detection unit 9A, with a pulse generation timing f the pulse generator 17 serving as a synchronous signal for the rotational angle detection signal of the backup roll 2, detects the rotational angle by using the pulses of the pulse generator 18 on the basis of this pulse generation timing. FIG. 9 shows this relationship and exemplifies particularly a case of k=3. To be specific, the pulse generator 17, as shown in FIG. 9A, generates one single pulse PG1 per rotation of the backup roll 2. The pulse generator 18, as shown in FIG. 9B, generates (3·n)-pieces of pulses OG2 per rotation of the backup roll 2. The rotational angle detection unit 9A, as shown in FIG. 9C, outputs a first rotational angle detection signal at the time of generating the pulse PG1, and thereafter outputs second through n-th rotational angle detection signals each time the number of pulses PG2 is counted 3.

The fourth embodiment exhibits an advantage of detecting the rotational angle of the backup roll with a higher accuracy more easily than in the preceding embodiments discussed above.

Figure 10:
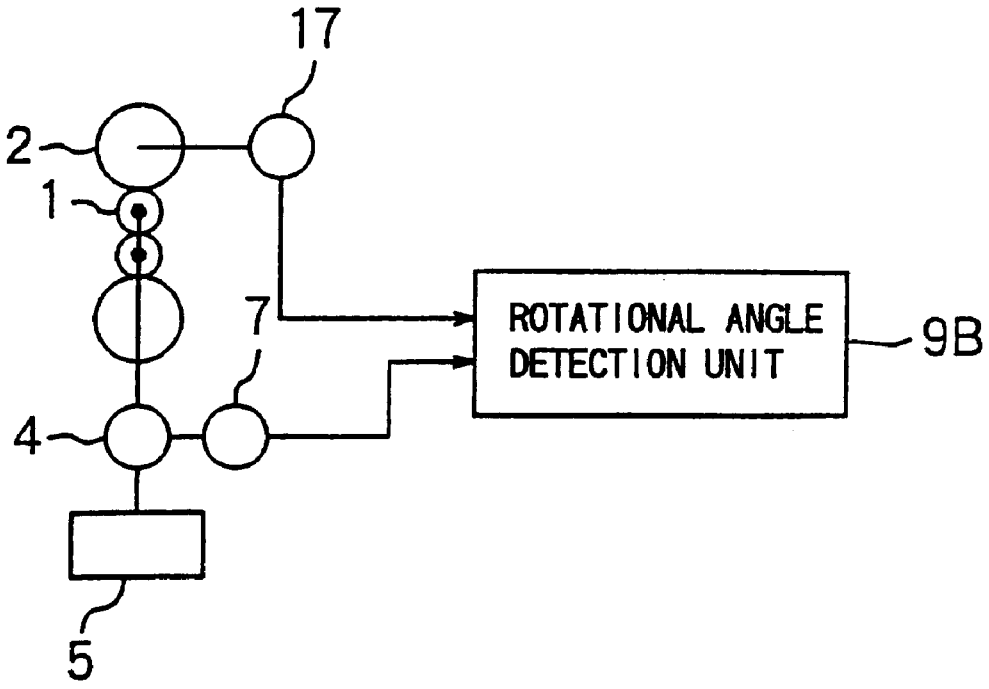
FIG. 10 is a block diagram showing, in combination of the rolling system, a construction of a fifth embodiment of the strip thickness controller for the rolling mill according to the present invention.

FIG. 10 is a diagram showing a part of construction of a fifth embodiment of the strip thickness controller for the rolling mill according to the present invention. The construction of the fifth embodiment is that the pulse generator 17 described above is connected to the backup roll 2, and the rotational angle detection unit 9B outputs the rotational angle detection signal on the basis of the pulse generated by the pulse generator 17 and the pulse generated by the pulse generator 7. More specifically, the rotational angle detection unit 9B outputs a first angle detection signal at a timing when the pulse generator 17 generates the pulse PG1, and second to n-th rotational angles are detected by use of the pulses generated from the pulse generator 8, which correspond to the rotation of the backup roll 2. In this case, let $N_M$ be a speed detected value of the rolling mill drive motor 4, and a rotational angle $\Delta\theta$ of the backup roll 2 is given by the formula (3) described above.

A point of time when the angle $\Delta\theta$ becomes equal to an angle $\Delta\theta_A$ of the backup roll 2 is coincident with a point of time of reaching the next rotational angle, at which time the rotational angle number j may be incremented by 1.

Figure 11:
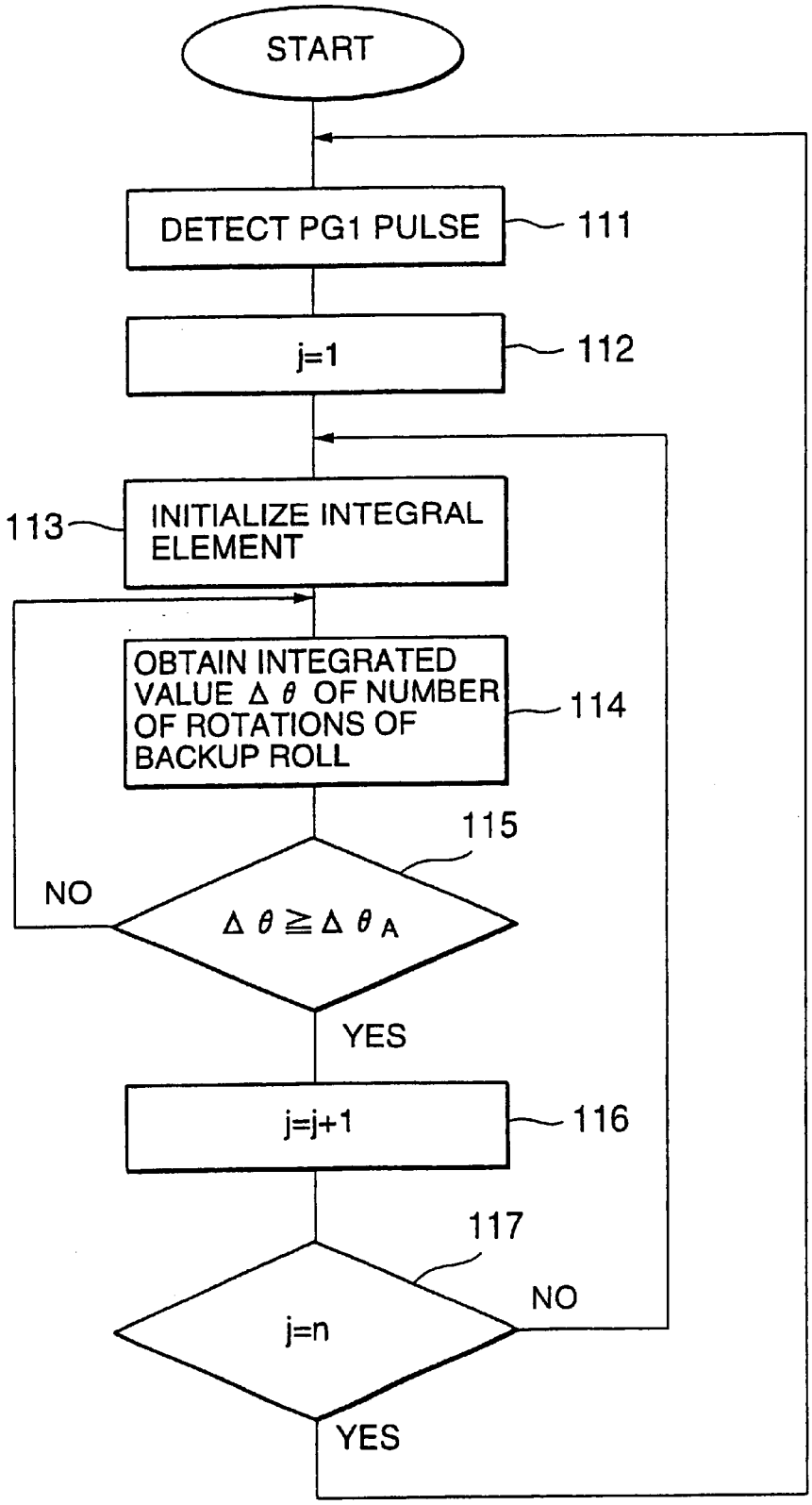
FIG. 11 is a flowchart showing a processing procedure of the rotational angle detection unit as a component of the construction of the fifth embodiment shown in FIG. 10.

FIG. 11 is a flowchart showing a processing procedure of the rotational angle detection unit 9B. That is, when detecting the pulse PG1 outputted from the pulse generator 17 in step 111, a first rotational angle detection signal is thus attained in step 112. Next, an integral element is initialized in step 113, and the integration of the number of rotations of the backup roll is executed (the number of pulses is counted) in step 114. It is judged in step 115 whether or not an integrated value $\Delta\theta$ thereof reaches a value $\Delta\theta_A$ by which the angle of one rotation of the backup roll is segmented equally by "n", if reached, the rotational angle number j is incremented by 1 in step 116, and subsequently it is judged in step 116 whether or not the rotational angle number reaches a preset value n. If not reached, the processes from step 113 onwards are repeated. Whereas if reached, the operation is looped back to step 111 onward.

Thus, according to the fifth embodiment, the output pulse PG1 from the pulse generator 17 is used as a fiducial position of the rotational angle, and hence the rotational angle of the backup roll can be detected with the high precision.

Figure 12:
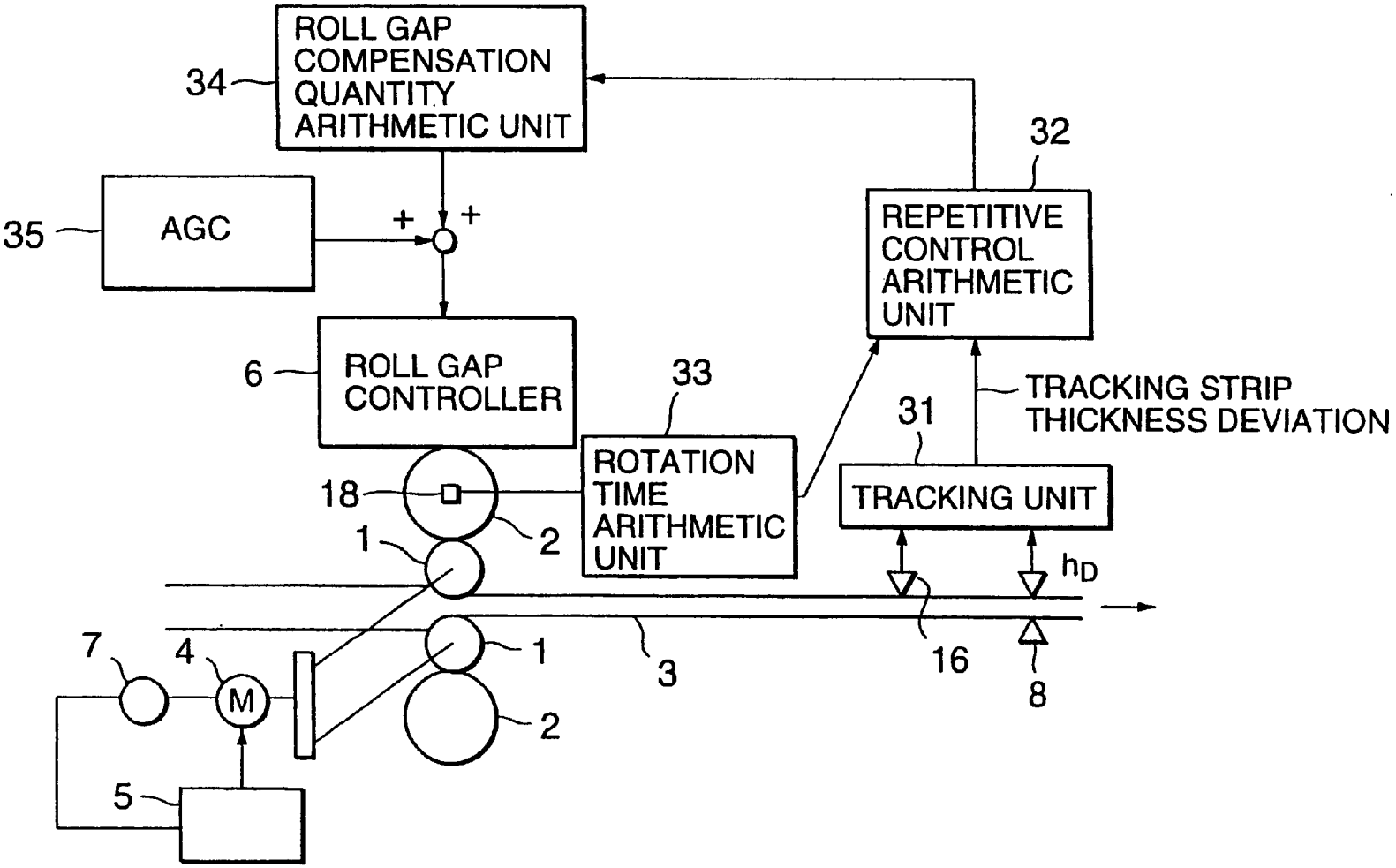
FIG. 12 is a block diagram showing a whole construction of a sixth embodiment of the present invention.

FIG. 12 is a block diagram showing a construction of a sixth embodiment of the present invention in combination with the rolling system. The controller shown herein includes a tracking unit 31, a repetitive control arithmetic unit 32 and a roll gap compensation quantity arithmetic unit 34.

The tracking unit 31 calculates a transfer time of the strip 3 which corresponds to a difference between a distance ($n\pi D_D$, where $D_D$ is a diameter of the backup roll) corresponding to n-rotations of the backup roll 2 and a distance of the thickness gauge 8 from the rolling mill. Then tracking unit 31 is delays a strip pressure deviation from the set value which is detected by the thickness gauge 8, corresponding to the above transfer time, and outputs the thus delayed deviation. The repetitive control arithmetic unit 32 inputs a tracking strip thickness deviation calculated by the tracking unit, and performs a repetitive control calculation by use of a control output of previous n-rotations (or previous one rotation) of the backup roll 2. The roll gap compensation quantity arithmetic unit 34 calculates a roll gap compensation quantity of the rolling mill by inputting the output from the repetitive control arithmetic unit 32, and sends this compensation quantity to the roll gap controller 6.

According to the present invention, the roll eccentricity is eliminated as follows:

The roll eccentricity is defined as a periodic disturbance corresponding to the rotation of the backup roll, and satisfies the following formula:

$$(1-o^{-tk\cdot S})\cdot\Delta S_R=0 \tag{7}$$

where $t_R$ is a one-rotation time [s] of the backup roll, and $\Delta S_R$ is the roll eccentricity [mm].

If the rolling speed is constant, the one-rotation time $t_R$ of the backup roll is given such as:

$$t_R = \frac{\pi\cdot D_B}{V_R} \tag{8}$$

where $v_R$ is a peripheral speed [m/s] of the work roll, and $D_D$ is a diameter [m] of the backup roll 2.

There is a considerable distance between the rolling mill and the thickness gauge 8, and consequently there might occur a time delay in the detection of the strip thickness. Namely, $$h_D=o^{-tx.s}\cdot h \tag{9}$$

Where h is a delivery-side strip thickness [mm] just under the rolling mill, $t_x$ is a strip transfer time [s] from the rolling mill down to the thickness gauge 8, and $h_D$ is a detected strip thickness [mm].

If the rolling speed is constant, the strip transfer time $t_x$ down to the thickness gauge 8 is given such as:

$$f_x = \frac{L_D}{V_R\cdot(l+f)} \tag{10}$$

where f is the forward slip [−], and $L_D$ is the distance [m] between the rolling mill and the thickness gauge 8.

If the transfer time $t_x$ from the rolling mill down to the thickness gauge 8 is longer than the one-rotation time $t_R$ of the backup roll 2, the strip 3 does not arrive at the thickness gauge 8, and the measurement is unable to be done. Hence, there is no alternative but to use the strip thickness deviation in the previous n-rotations of the backup roll 2.

According to the present invention, it is to be presumed that the transfer time $t_x$ down to the thickness gauge 8 is longer than a time of (n−1) rotations of the backup roll 2 but shorter than a time of n-rotations thereof.

In this case, the following relationship is established:

$$(n-1)-t_R=t_{(n-1)R}<t_x<t_{nR}=n\cdot t_R \tag{11}$$

$$(n-1)\cdot\pi\cdot D_P\cdot(1+f)<L_b<n\cdot\pi\cdot D_D\cdot(1+f) \tag{12}$$

Figure 13:
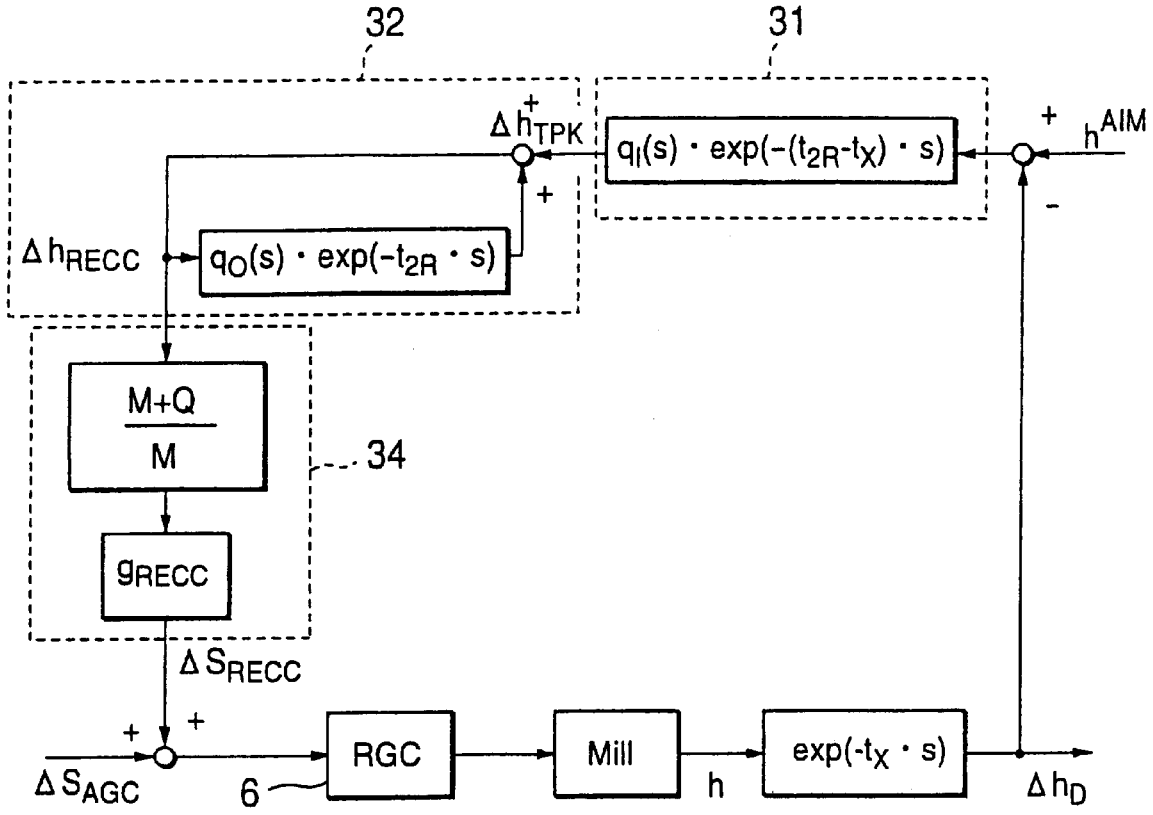
FIG. 13 is a diagram showing a control flow in the sixth embodiment of the present invention.

Next, a sixth embodiment of the present invention will be discussed with reference to FIGS. 12–14.

The sixth embodiment, as an exemplification of the case where the strip transfer time down to the thickness gauge 8 is longer than a time of (n−1) rotations of the backup roll 2 but shorter than a time of n-rotations thereof, gives such an example that the transfer time $t_x$ down to the thickness gauge 8 is longer than a time of one rotation of the backup roll 2 but shorter than a time of 2 rotations thereof.

Namely, the formulae (11) and (12) are transformed into the following formulae (13) and (14).

$$t_R<t_x<t_{2R}=2\cdot t_R \tag{13}$$

$$\pi\cdot D_B\cdot(1+f)<L_D<2\cdot\pi\cdot D_B\cdot(1+f) \tag{14}$$

1) To start with, a rotation time arithmetic unit 33 calculates a 2-rotations time $t_{2R}$ of the backup roll 2.

$$\sum_{i=0}^{t_R[k]-1} P_B[k-i] \approx 2\cdot P_{Btcv} \tag{15}$$

$$t_{2R}[k]=k_{2R}[k]\cdot dt \tag{16}$$

where $P_B$ is the number of pulses generated by the pulse generator for detecting the rotational angle of the backup roll 2, $P_{Brev}$ is the number of pulses in one rotation which are generated by the pulse generator 18, dt is a sampling cycle [s], k is the number of steps (time t=k·dt), and $k_{2R}$ is the number [−] of steps for a time of two rotations of the backup rolls.

2) The tracking unit 31 calculates a distance corresponding to two rotations of the backup roll 2 and a strip transfer time $t_{2RD}$ corresponding to the difference between the rolling mill and the thickness gauge 8 by use of the obtained 2-rotations time $t_{2R}$ of the backup roll 2, where $t_{3RD}=(t_{2R}-t_x)$.

$$\sum_{i=0}^{k_{ZR}[k]-1} V_D[k-i]\cdot dt \approx 2\cdot D_B\cdot\pi\cdot(1+f)-L_D+V_R[k]\cdot t_{gauge} \tag{17}$$

Alternatively, $$\sum_{i-L_{ZB}[k]-L_{ZRV}[k]}^{k_{ZR}[k]-1} V_D[k-i]\cdot dt \approx L_D-V_D[k]\cdot t_{gauge} \tag{18}$$

$$t_{2RD}[k]=k_{2RD}[k]\cdot dt \tag{19}$$

where $V_D$ is the delivery-side strip speed [m/s], $L_D$ is the distance between the rolling mill and the thickness gauge, $t_{gauge}$ is a detection delay time [s] of the thickness gauge, and k2RD is the number-of-steps [−] corresponding to the strip transfer time.

3) The tracking unit tracks the delivery-side strip thickness deviation.

$$\Delta h_{TRK}[k]==\Delta h_D\,[k-k_{2RD}[k]] \tag{20}$$

where what is given by $\Delta h_D[k]=h_D[k]-h^{AIM}$ is the strip thickness deviation [mm] detected by the thickness gauge, and $\Delta h_{TRK}[k]$ is the tracked delivery-side strip thickness deviation [mm].

The repetitive control calculation is performed by use of the delivery-side strip thickness deviation $\Delta h_{TRK}$ is obtained by the tracking unit 31.

$$\Delta h_{RECC}[k]=\Delta h_{TRK}[K]+\Delta h_{RECC}[k-k_{2RD}[k]] \tag{21}$$

where $\Delta h_{RECC}$ is the repetitive calculation delivery-side strip thickness deviation [mm].

Figure 14:
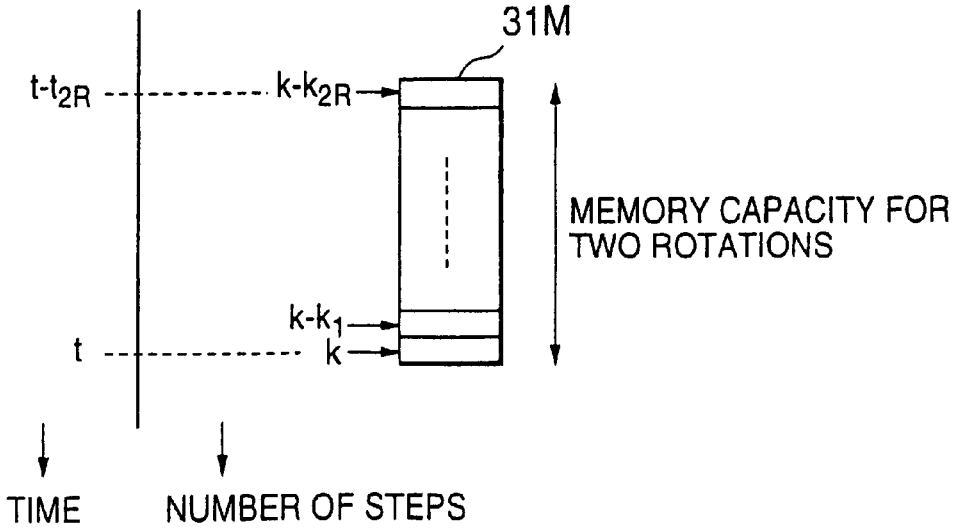
FIG. 14 is a strip thickness deviation table in the sixth embodiment of the present invention.

Note that an internal memory 31M is, as shown in FIG. 14, stored with the delivery-side strip thickness deviation $\Delta h_{RECC}$ by way of a table in a format corresponding to the above steps.

5) The roll gap compensation quantity arithmetic unit 34 calculates a roll gap compensation quantity by use of the strip thickness deviation $\Delta h_{RECC}$.

$$\Delta S_{RECC}[k] = g_{RECC}\cdot\frac{M+Q}{M}\cdot\Delta h_{RECC}[k] \tag{22}$$

where $g_{RECC}$ is a roll eccentricity retransfer gain [−], M is an elastic coefficient [kN/mm] of the rolling mill, Q is a plasticity coefficient [kN/mm] of the strip, and $\Delta S_{RECC}[k]$ is a roll gap compensation quantity [mm].

This compensation quantity $\Delta S_{RECC}$ is added to a roll gap set value $S_{AGC}$ given from an auto strip thickness control unit (AGC) 35, and the added value is supplied to the roll gap controller 6.

Incidentally, the roll eccentricity retransfer gain is set to satisfy the following formula in terms of a condition of stability.

$$0=g_{RECC}<1 \tag{23}$$

In this relationship, the response becomes faster as the gain get more approximate to 1, and becomes oscillatory if over 1.

As described above, there are executed the repetitive control calculates of the with which to delay the output of the thickness gauge 8 by the strip transfer time corresponding to the difference between the distance corresponding to the n-rotations of the backup roll 2 and the distance of the thickness gauge 8 from the rolling mill, and of the control output in the previous n-rotations (or previous one rotation) of the backup roll 2. Then, the roll gap compensation quantity is calculated from the output of that repetitive control calculations, and the roll gap of the rolling mill is controlled, whereby the rolling mill is capable of preventing the kiss-roll. In the thus constructed rolling mill also, the delivery-side strip thickness deviation due to the eccentricity of the backup roll can be reduced.

Figure 15:
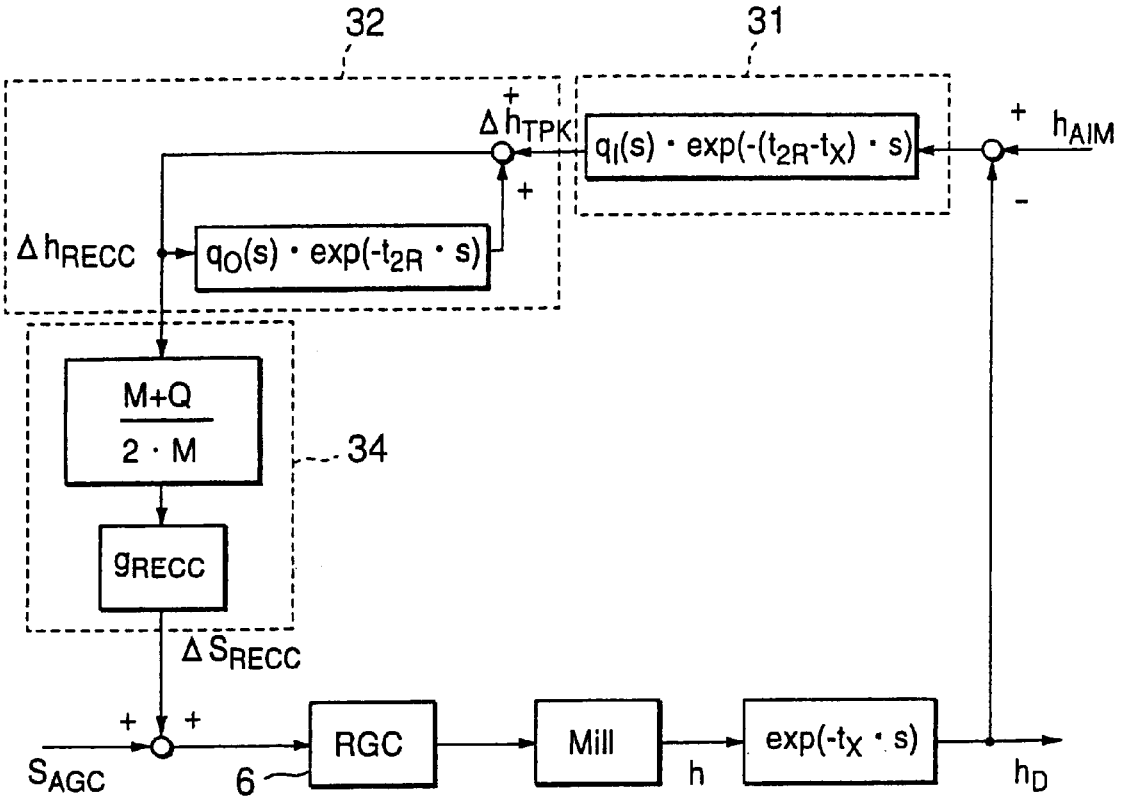
FIG. 15 is a diagram showing a control flow in a seventh embodiment of the present invention.

Next, a seventh embodiment of the present invention will be explained referring to FIGS. 15 and 16.

The repetitive cycle is the n-rotations in the sixth embodiment. The seventh embodiment, however, gives an example where the repetitive cycle is one rotation. The calculation process is executed in the same procedure as that in the sixth embodiment.

1) The 2-rotations time $t_{2R}$ of the backup roll is calculated.

$$\sum_{i=0}^{k_{2R}[k]-1} P_B[k-i] \approx 2\cdot P_{Brev} \tag{24}$$

$$t_{2R}[k] \approx k_{2R}[k]\cdot dt \tag{25}$$

1') The one-rotation time tR of the backup roll is calculated.

$$\sum_{i=0}^{k_R[k]-1} P_B[k-i] \approx P_{Brev} \tag{26}$$

$$t_R[k] \approx k_R[k]\cdot dt \tag{27}$$

where $k_R$ is the number-of-steps [−] for one-rotation time of the backup roll.

2) Calculated is the strip transfer time $t_{2RD}$ corresponding to the difference between the distance corresponding to the 2-rotations of the backup roll and the distance of the thickness gauge from the rolling mill.

$$\sum_{i=k_{2R}[k]-k_{2RD}[k]}^{p_{2R}[k]-1} V_D[k-i]\cdot dt \approx L_D - V_D[k]\cdot t_{gauge} \tag{28}$$

$$t_{2RD}[k] \approx k_{2RD}[k]\cdot dt \tag{29}$$

$$t_{2RD}[k]\approx k_{2RD}[k]\cdot dt \tag{29}$$

3) The delivery-side strip thickness deviation is tracked.

$$\Delta h_{TRK}[k]=-\Delta h_D[k-k_{2RD}[k]] \tag{30}$$

4') The repetitive control calculation is effected.

$$\Delta h_{RECC}[k]=\Delta h_{TRK}[K]+\Delta h_{RECC}[k-k_R[k]] \tag{31}$$

5') The roll gap compensation quantity is calculated.

$$\Delta S_{RECC}[k] = g_{RECC}\cdot\frac{M+Q}{2\cdot M}\cdot\Delta h_{RECC}[k] \tag{32}$$

The repetitive control arithmetic unit 32 is, unlike the tracking unit 31, if able to use nothing but the strip thickness deviation in the previous n-rotations of the backup roll, capable of retransfer that deviation in an approximate manner even when the cycle is set to one rotation if considering that the roll eccentricity is, though the repetitive cycle is set to the n-rotations, substantially the same as the rotational angle of the backup roll.

Figure 16:
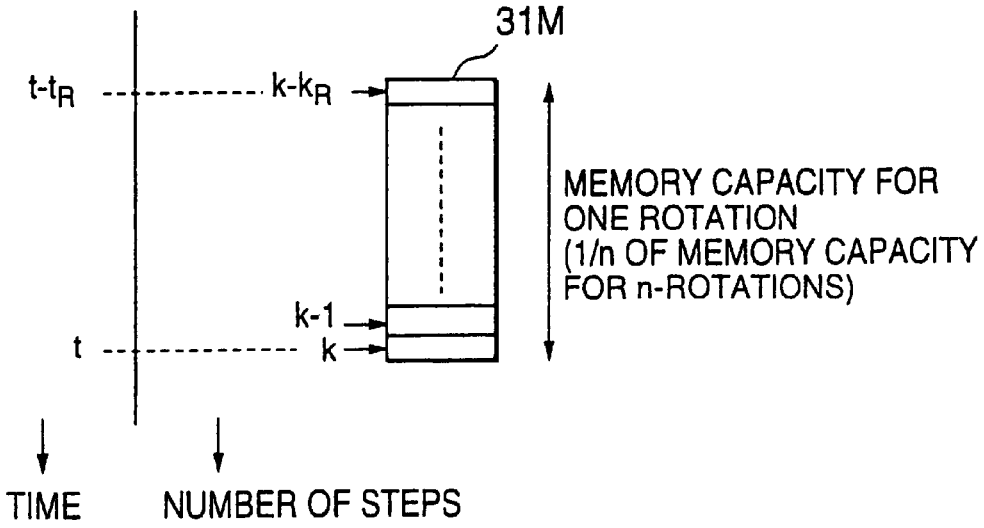
FIG. 16 is a strip thickness deviation table in the seventh embodiment of the present invention.

Accordingly, as obvious from a comparison between FIG. 14 and FIG. 16, the memory capacity of the repetitive control arithmetic unit 32 can be reduced by a factor of ⁻n⁻.

Figure 17:
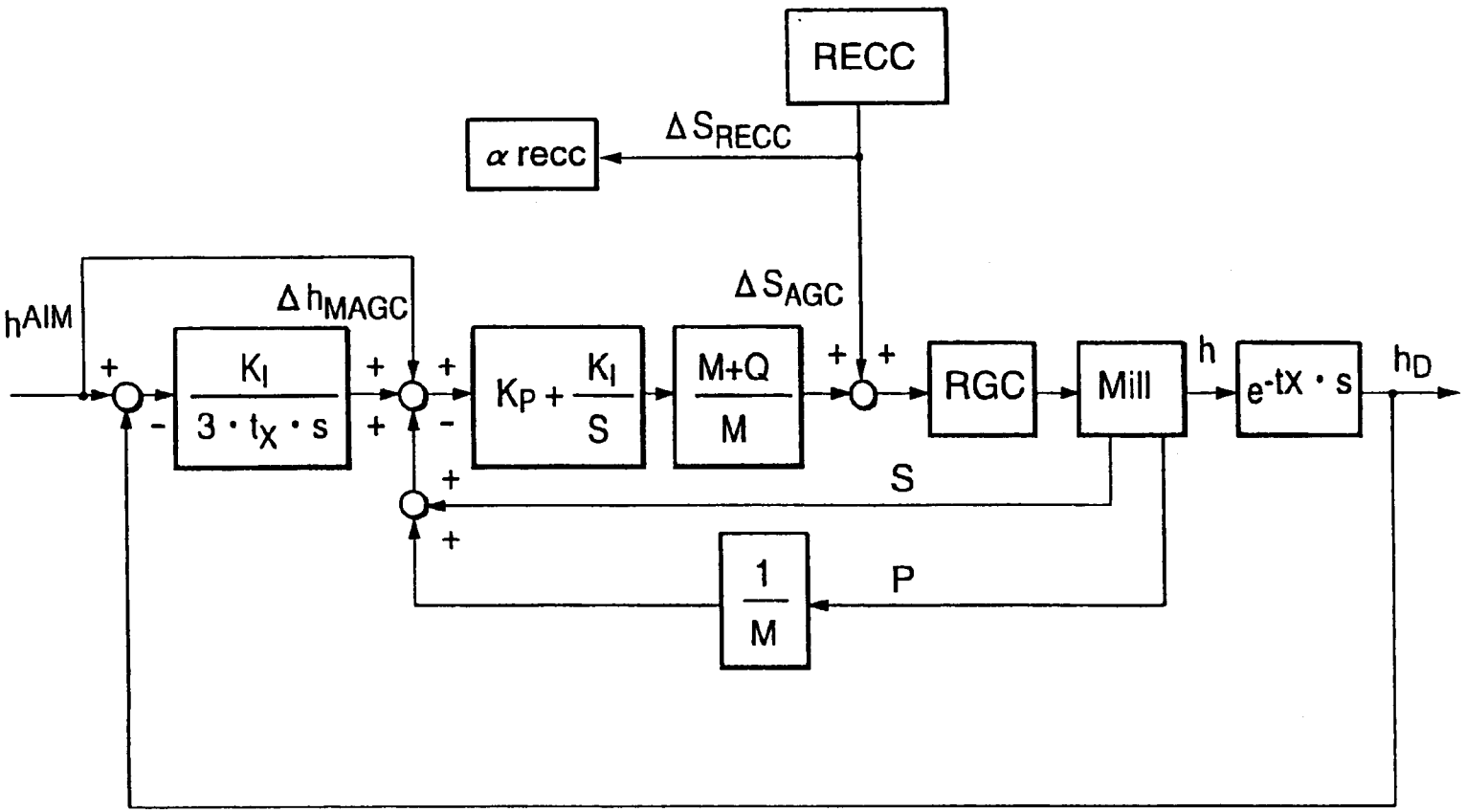
FIG. 17 is a diagram showing a control flow in an eighth embodiment of the present invention.

Next, an eighth embodiment of the present invention will be discussed with reference to FIG. 17.

The auto strip thickness control normally involves a control process using a gauge meter strip thickness.

The roll gap control quantity under the auto strip thickness control is given, for example, as follows:

$$\Delta S_{AGC} = \frac{M+Q}{M} \cdot \left(K_P + \frac{K_I}{s}\right) \cdot (h^{AIM} - h_{GM} + \Delta h_{MAGC}) \tag{33}$$

The gauge meter equation is:

$$h_{GM} = S + \frac{1}{M} \cdot P \tag{34}$$

where $K_P$ is a proportional gain [−], $K_I$ is an integral gain [1/s], $h_{GM}$ is a gauge meter strip thickness [mm]. S is a roll gap, P is a rolling force, $$\Delta h_{MAGC} = \frac{K_I}{3 \cdot t_x \cdot s} \cdot (h^{AIM} - h_D)$$

is a monitor auto strip thickness control modification control [mm], Ki is a monitor auto strip thickness control integral gain [1/s], and $t_X$ is a transfer time from the rolling mill down to the thickness gauge.

If there is the roll eccentricity under the strip thickness control using the gauge meter equation, a roll eccentricity influence upon the delivery-side strip In this embodiment, the following roll eccentricity retransfer compensation is effected on the gauge meter strip thickness.

$$h_{CM} = S + \frac{1}{M} \cdot P - \alpha_{RECC} \cdot \Delta S_{RECC} \tag{35}$$

where $\alpha_{RECC}$ is a roll eccentricity compensation gain [−].

Thus, it is feasible to reduce the influence of the roll eccentricity upon the delivery-side strip thickness by use of the gauge meter equation.

Next, a ninth embodiment of the present invention will be discussed.

The sixth and seventh embodiments are applicable to the case where the rotational angle of the backup roll can be detected. If unable to detect the rotational angle of the backup roll, however, a rotating time of the backup roll is calculated from a rotational angle (or a peripheral speed) of the work roll in the manner which follows:

1) A 2-rotations time $t_{2R}$ of the backup roll is calculated (in the case of n-rotations cycle).

$$L_{2R}[k] = \sum_{i=0}^{k_{2R}[k]-1} V_g[k-i] \cdot dt \approx 2 \cdot D_B \cdot \pi \tag{36}$$

$$t_{2R}[k] \approx k_{2R}[k] \cdot dt \tag{37}$$

where $L_{2R}$ is a distance [m] corresponding to two rotations of the backup roll:

$$V_R[k] = \frac{\theta_W[k] - \theta_W[k-1]}{dt} \cdot \frac{D_W}{2},$$

$D_W$ is a diameter of the work roll and $\theta_W$ is a rotational angle [rad] of the work roll.

1') A one-rotation time tR of the backup roll is calculated (in the case of one-rotation cycle).

$$L_R[k] = \sum_{i=0}^{k_R[k]-1} V_R[k-i] \cdot dt \approx D_P \cdot \pi \tag{38}$$

$$t_R[k] \approx k_R[k] \cdot dt \tag{39}$$

where $L_R$ is a distance [m] corresponding to one rotation of the backup roll.

Subsequent calculations are performed in the same way as those in the sixth or seventh embodiment.

Next, a tenth embodiment of the present invention will be described.

If incapable of detecting the rotational angle of the backup roll, there might arise a possibility of being unable to enhance the accuracy of the rotational angle because of calculating the above rotational angle from the roll diameter. In this case, the roll eccentricity retransfer accuracy might decline.

In that case, if capable of detecting the one-rotation time of the backup roll 2 by using, e.g., the pulse generator shown in FIG. 8 or a proximity switch, the accuracy of the rotational angle can be enhanced by use of the above generator or switch.

To be specific, the backup roll diameter is learnt as in the following formula, thereby enhancing the accuracy of the rotational angle.

$$D_B = D_B^{OLD} + \beta \cdot \left( \frac{\sum_{i=0}^{k_{PX}-1} V_R[k-i] \cdot dt}{\pi} - D_o^{OLD} \right) \tag{40}$$

$$t_{PX}[k] \approx k_{PX}k] \cdot dt \tag{41}$$

where $t_{PX}$ is a one-rotation time [s] of the backup roll when using the proximity switch, B is a learning gain [−], and $D_R^{OLD}$ is a backup roll diameter [m] before learning.

In the ninth embodiment, if unable to detect the rotational angle of the backup roll, the rotational angle is calculated by use f the roll diameter. In this case, however, if the roll diameter does not exhibit a high accuracy, the precision of the rotational angle might decline. Accordingly, in the tenth embodiment, if capable of detecting the one-rotation time even though unable to detect the rotational angle, the roll diameter is learnt by using this one-rotation time, thereby enhancing the accuracy of the rotational angle.

Next, an eleventh embodiment of the present invention will be discussed.

Figure 18:
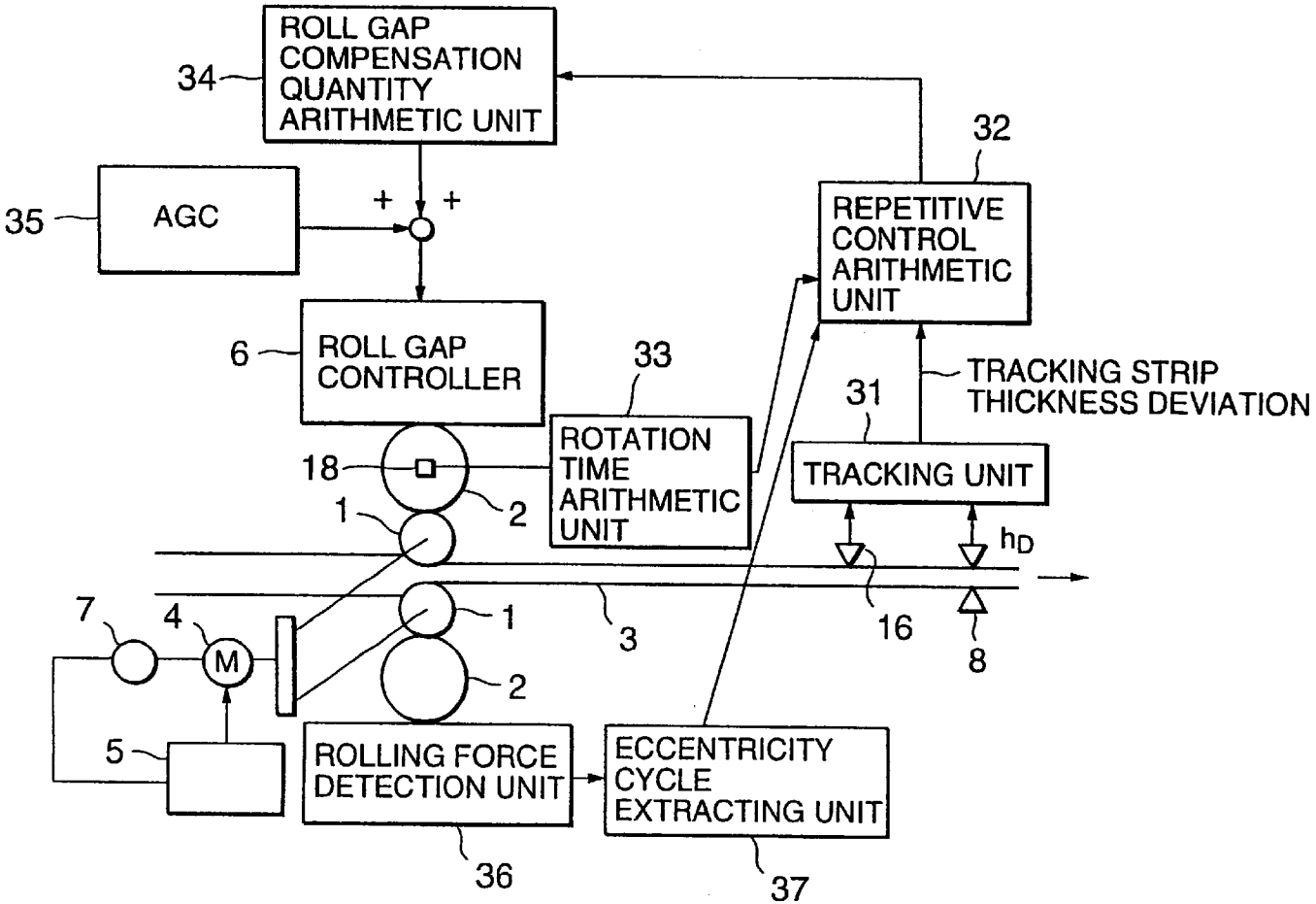
FIG. 18 is a block diagram showing other embodiment of the present invention.

Herein, as shown in FIG. 18, there are provided a rolling force detection unit 36 and an eccentricity cycle extraction unit 37.

The one-rotation time $t_{FX}$ of the backup roll can be detected from a fluctuation cycle of the rolling force due to the roll eccentricity. To describe it more specifically, for instance, if the rolling force changes in a shape of sine wave due to the roll eccentricity, a time t at which an auto-correlation function R(t) of the rolling force is maximized, becomes a cycle of this sine wave.

In accordance with the eleventh embodiment, the one-rotation time of the backup roll is calculated from the time at which the auto-correlation function of the rolling force is maximized by use of the following formulae. That is, the rolling force detection unit 36 detects a rolling force P of the rolling mill, and the eccentricity cycle extraction unit 37, based on this detected rolling force P, calculates an auto-correlation coefficient $R(t_{PX})$ in the manner which follows.

$$R(t) = \frac{1}{k_{\max}} \cdot \sum_{k=0}^{k=-k_{\max}} P(k) \cdot P(k-t) \tag{42}$$

where P is the rolling force [kN], and $k_{MAX}$ is the number of sampling [m].

$$R(t_{PX}) = \mathrm{Max}[R(t)] \tag{43}$$

Next, a twelfth embodiment of the present invention will be explained.

Whether capable or incapable of detecting the rotational angle of the backup roll, the roll eccentricity retransfer accuracy declines if the backup roll rotation time is not detected with the high accuracy.

In this case, an error in the rotational time of the backup roll is rounded by using a low-pass filter (e.g., a movement average) whereby the roll eccentricity retransfer accuracy In this case, an error in the rotation time of the backup roll is rounded by using a low-pass filter (e.g., a movement average), whereby the roll eccentricity retransfer accuracy can be enhanced.

Namely, the repetitive control arithmetic unit 32 performs the following calculation.

4) Repetitive control calculation (in the case of the two-rotation cycle):

$$\Delta h_{RECC}[k] = \Delta h_{TRK}[k] + \frac{\begin{pmatrix} \Delta h_{RECC}[k - k_{2R}[k]] + \\ f_1 \cdot (\Delta h_{RECC}[k - k_{2R}[k] - 1] + \Delta h_{RECC}[k - k_{2R}[k] + 1])/2 + \\ f_2 \cdot (\Delta h_{RECC}[k - k_{2R}[k] - 2] + \Delta h_{RECC}[k - k_{2R}[k] + 2])/2 \end{pmatrix}}{1 + f_1 + f_2} \tag{44}$$

where f1 and f2 are filter gains [−].

4') Repetitive control calculation (in the case of the one-rotation cycle):

$$\Delta h_{RECC}[k] = \Delta h_{TRK}[k] + \frac{\begin{pmatrix} \Delta h_{RECC}[k \sim k_R[k]] + \\ f_1 \cdot (\Delta h_{RECC}[k - k_R[k] - 1] + \Delta h_{RECC}[k - k_R[k] + 1])/2 + \\ f_2 \cdot (\Delta h_{RECC}[k - k_R[k] - 2] + \Delta h_{RECC}[k - k_R[k] + 2])/2 \end{pmatrix}}{1 + f_1 + f_2} \tag{45}$$

Next, a thirteenth embodiment of the present invention will be discussed.

The strip transfer time, if capable of detecting the speed of the strip, does not present any problems. If incapable of detecting the speed of the drip, however, the strip transfer time is obtained from a peripheral speed $V_R$ in the following manner. The peripheral speed $V_r$ is to be obtained from a time change of the rotational angle of the work roll and from the work roll diameter as well.

The tracking unit 31 calculates a strip transfer time $t_{2RD}$ corresponding to a difference between the distance corresponding to two rotations of the backup roll and the distance of the thickness gauge from the rolling mill.

$$L_{2RD}[k] = \sum_{i=0}^{k_{2RD}[k]-1} V_R[k-i] \cdot dt \approx 2 \cdot D_B \cdot \pi - \frac{L_D}{1+f} + \frac{V_R[k] \cdot t_{gauge}}{1+f} < D_B \cdot \pi \tag{46}$$

$$t_{2RD}[k] \approx k_{2RD}k] \cdot dt \tag{47}$$

where f is the forward slip.

Note that an actual strip transfer time down to the thickness gauge 8 is detected some method (such as using, e.g., a marker put in a given position of the strip, and the forward slip is learnt, thereby enhancing the accuracy of the transfer time.

Next, a fourteenth embodiment of the present invention will be discussed.

If the strip transfer time does not have the high accuracy, the roll eccentricity retransfer accuracy might decline.

In this case, when obtaining a tracking strip thickness deviation, an error in the transfer time is rounded by using the low-pass filter (e.g., the movement average), whereby the roll eccentricity retransfer accuracy can be enhanced by performing the calculation in the following formula:

$$\Delta h_{TRK}[k] = \frac{\begin{pmatrix} \Delta h_D[k - k_{2RD}[k]] + \\ f_{RECC1} \cdot (\Delta h_D[k - k_{2RD}[k] - 1] + \Delta h_D[k - k_{2RD}[k] + 1])/2 + \\ f_{RECC2} \cdot (\Delta h_D[k - k_{2RD}[k] - 2] + \Delta h_D[k - k_{2RD}[k] + 2])/2 \end{pmatrix}}{1 + f_{RECC1} + f_{RECC2}} \tag{48}$$

where $f_{RECC1}$ and $f_{RECC2}$ are filter gains.

Subsequently, a fifteenth embodiment of the present invention will be discussed.

In the repetitive control calculation, the control output at the last cycle is stored, and hence, if an abnormal value is inputted, a control accuracy thereafter will be lowered. For coping with this, the control outputs stored are somewhat de-memorized.

The following is the specific operation.

4) The repetitive control calculation is carried out (in the case of the two-rotations cycle).

$$\Delta h_{RECC}[k] = \Delta h_{TRK}[k] + \alpha \cdot \Delta h_{RECC}[k - k_{2R}[k]] \tag{49}$$

where α is a forgetting coefficient [−].

4') The repetitive control calculation is implemented (in the case of the one-rotation cycle).

$$\Delta h_{RECC}[k] = -\Delta h_{TRK}[k] + \alpha \cdot h_{RECC}[k - k_R[k]] \tag{50}$$

Each of the embodiments discussed above aims at the four-high rolling mill including the pair of backup rolls disposed upwardly and downwardly of the couple or work rolls. The present invention is not, however limited to this type of rolling mill but may be applied to a rolling mill having a greater number of rolls.

Further, the discussions in the respective embodiments given above are based on the assumption that the digital signal processor such as a computer etc. incorporates the function of processing the outputs of the pulse generator and of the thickness gauge, however, a part of that function may be, as a matter of course, attained by hardware.

What is claimed is:

1. A strip thickness controller for a rolling mill, comprising:

a thickness gauge, provided in a position spaced a distance shorter than a circumference of each of backup rolls of the rolling mill on a delivery side of said rolling mill having work rolls and the backup rolls, for detecting a strip thickness deviation from a strip thickness set value;

a rotational angle detection unit for outputting a rotational angle detection signal at every equally-segmented portion when an angle of one rotation of said backup rolls is, with "n" being a positive integer, segmented equally by "n";

a strip length arithmetic unit for calculating a forward slip of said rolling mill at a point of time when a first rotational angle detection signal is outputted from said rotational angle detection unit, and calculating, based on the forward slip and the circumference of said backup roll or a value relative thereto, a delivery-side strip length of said rolling mill which corresponds to one rotation of said backup roll;

a strip thickness deviation delay unit for delaying a strip thickness deviation signal of said thickness gauge by a strip transfer time corresponding to a difference between the delivery-side strip length calculated by said strip length arithmetic unit and a distance of said thickness gauge from said rolling mill;

a roll gap control quantity arithmetic unit for integrating the strip thickness deviation signal delayed by said strip thickness deviation delay unit at the every same rotational angle of said backup roll which is detected by said rotation angle detection unit, and calculating each roll gap control quantity of said rolling mill, corresponding to the rotational angle of said backup roll; and a roll gap controller for controlling a roll gap of said rolling mill in accordance with the roll gap control quantity calculate by said roll gap control quantity arithmetic unit.

2. A strip thickness controller for a rolling mill according to claim 1, further comprising:

number-of-rotations detecting means for detecting the number of rotations of a rolling mill drive motor, wherein said rotational angle detection unit integrates an output signal of said number-of-rotations detecting means, and outputs a rotational angle detection signal of said backup roll each time an integrated value thereof reaches a predetermined value.

3. A strip thickness controller for a rolling mill according to claim 1, further comprising:

a first pulse generator for generating one single pulse each time said backup roll makes one rotation; and a second pulse generator for generating, with "m" being an integer equal to or larger than "n", m-pieces of pulses each time said backup roll makes one rotation, wherein said rotational angle detection unit outputs n-pieces of rotational angle detection signals of said backup roll by use of the m-pieces of pulse signals generated from said second pulse generator on the basis of a point of time when said first pulse generator generates the pulse.

4. A strip thickness controller for a rolling mill according to claim 1, further comprising:

number-of-rotations detecting means for detecting the number of rotations of a rolling mill drive motor; and a pulse generator for generating one single pulse each time said backup roll makes one rotation, wherein said rotational angle detection unit integrates, on the basis of a point of time when said pulse generator generates the pulse, an output signal of said number-of-rotations detecting means, and outputs a rotational angle detection signal of said backup roll each time an integrated value thereof reaches a predetermined value.

5. A strip thickness controller for a rolling mill, comprising:

thickness gauge, provided in a position spaced a distance shorter than a circumference of each of backup rolls of said rolling mill on a delivery side of said rolling mill having work rolls and the backup rolls, for detecting a strip thickness deviation from a strip thickness set value;

a rotational angle detection unit for outputting a rotational angle detection signal at every equally-segmented portion when an angle of one rotation of said backup rolls is, with "n" being a positive integer, segmented equally by "n";

work roll speed detecting means for detecting a speed of said work roll of said rolling mill;

a strip length calculating/storing unit for calculating, with "j" being an arbitrary integer equal to or smaller than "n", a forward slip of said rolling mill at a point of time when a j-th rotational angle detection signal of said backup roll is outputted from said rotational angle detection unit, calculating a delivery-side strip speed of said rolling mill on the basis of this forward slip and a speed of said work roll, calculating a j-th delivery-side strip length in said rolling mill on the basis of the strip speed and an elapse time from a (j−1)th rotational angle through the j-th rotational angle of said backup roll, and sequentially storing the delivery-side strip length;

a thickness gauge arrival strip detection unit for integrating the delivery-side strip lengths tracking back to the past from the j-th length which are stored in said strip length calculating/storing unit, and detecting such a rotational angle number of said backup roll that the integrated value corresponds to a distance between said rolling mill and said thickness gauge;

a strip thickness deviation storage unit, having n-pieces storage areas, for sequentially storing the strip thickness deviation detected by said thickness gauge in said storage area corresponding to the rotational angle of said backup roll, and outputting the previous strip thickness deviation in said storage area which is stored with a delay corresponding to the rotational angle number detected by said thickness gauge arrival strip detection unit as viewed from said present storage area;

a roll gap control quantity arithmetic unit for integrating the strip thickness deviation signal delayed by said strip thickness deviation storage unit at the every same rotational angle of said backup roll which is detected by said rotational angle detection unit, and calculating each roll gap control quantity of said rolling mill, corresponding to the rotational angle of said backup roll; and a roll gap controller for controlling a roll gap of said rolling mill in accordance with the roll gap control quantity calculated by said roll gap control quantity arithmetic unit.

6. A strip thickness controller for a rolling mill, comprising:

a thickness gauge, provided in a position spaced a distance shorter than a circumference of each of backup rolls of said rolling mill on a delivery side of said rolling mill having work rolls and the backup rolls, for detecting a strip thickness deviation from a strip thickness set value;

a rotational angle detection unit for outputting a rotational angle detection signal at every equally-segmented portion when an angle of one rotation of said backup rolls is, with "n" being a positive integer, segmented equally by "n";

a strip speed meter for detecting a strip transfer speed on a delivery side of said rolling mill;

a strip length calculating/storing unit for calculating, with "j" being an arbitrary integer equal to or smaller than "n", at a point of time when said rotational angle detecting means outputs the j-th rotational angle detection signal of said backup roll, a j-th delivery-side strip length of said rolling mill on the basis of the strip transfer speed detected by said strip speed meter and an elapse time from a (j−1)th rotational angle through the j-th rotational angle of said backup roll, and sequentially storing the delivery-side strip length;

a thickness gauge arrival strip detection unit for integrating the delivery-side strip lengths tracing back to the past from the j-th strip length which are stored in said strip length calculating/storing unit, and detecting such a rotational angle number of said backup roll that the integrated value corresponds to a distance between said rolling mill and said thickness gauge;

a strip thickness deviation storage unit, having n-pieces storage areas, for sequentially storing the strip thickness deviation detected by said thickness gauge in said storage area corresponding to the rotational angle of said backup roll, and outputting the previous strip thickness deviation if said storage area which is stored with a delay corresponding to the rotational angle number detected by said thickness gauge arrival strip detection unit as viewed from said present storage area;

a roll gap control quantity arithmetic unit for integrating the strip thickness deviation signal delayed by said strip thickness deviation storage unit at the every said rotational angle of said backup roll which is detected by said rotational angle detection unit, and calculating each roll gap control quantity of said rolling mill, corresponding to the rotational angle of said backup roll; and a roll gap controller for controlling a roll gap of said rolling mill in accordance with the roll gap control quantity calculated by said roll gap control quantity arithmetic unit.

7. A strip thickness controller for a rolling mill, comprising:

a thickness gauge, provided on a delivery side of said rolling mill including work rolls and backup rolls, for detecting a strip thickness deviation from a strip thickness set value;

a pulse generator for generating a pulse at every predetermined rotational angle of said backup roll;

a strip speed meter for detecting strip speed on the delivery side of said rolling mill;

a rotation time arithmetic unit for calculating, when n>1, an n-rotations time of said backup roll on the basis of an output of said pulse generator;

a tracking unit for delaying an output of said thickness gauge by a strip transfer time corresponding to a difference between a strip transfer distance corresponding to n-rotations of said backup roll and a distance of said thickness gauge from said rolling mill;

a repetitive control arithmetic unit for making a repetitive control calculation of a strip thickness deviation, as a control quantity, in previous n-rotations of said backup roll which is outputted from said tracking unit;

a roll gap compensation quantity arithmetic unit that calculates a roll gap compensation quantity from an output of said repetitive control arithmetic unit; and a roll gap controller for controlling a roll gap of said rolling mill in accordance with the roll gap compensation quantity.

8. A strip thickness controller for a rolling mill according to claim 7, wherein the output of said repetitive control arithmetic unit is compensated by auto strip thickness control means using a gauge meter strip thickness system.

9. A strip thickness controller for a rolling mill according to claim 7, wherein said rotation time arithmetic unit calculates a one-rotation or n-rotations time of said backup roll from the output pulse from said pulse generator and a roll diameter ratio of said backup roll with respect to said work out.

10. A strip thickness controller for a rolling mill according to claim 7, wherein said rotation time arithmetic unit includes rotational angle learning means for learning and compensating the backup roll rotational angle calculated from the one-rotation time of said backup roll.

11. A strip thickness controller for a rolling mill according to claim 7, further comprising:

a rolling force detection unit for detecting a rolling force; and an eccentricity cycle extracting unit for extracting a one-rotation time of said backup roll on the basis of the rolling force detected by said rolling force detecting means, wherein said rotation time arithmetic unit learns the rotational angle of said backup roll by use of the one-rotation time extracted by said eccentricity cycle extracting unit.

12. A strip thickness controller for a rolling mill according to claim 7, wherein said repetitive control arithmetic unit includes a filter for cutting a high-frequency component of the input signal.

13. A strip thickness controller for a rolling mill according to claim 7, wherein a strip speed on the delivery side of said rolling mill is calculated from the forward slip of said rolling mill and from the work roll rotational angle obtained from said pulse generator.

14. A strip thickness controller for a rolling mill according to claim 7, wherein said thickness gauge includes a filter, disposed at an output stage thereof, for cutting a high-frequency component contained in the input signal.

15. A strip thickness controller for a rolling mill according to claim 7, wherein said repetitive control arithmetic unit includes a de-memorizing means for de-memorizing a part of the signals stored.

16. A strip thickness controller for a rolling mill, comprising:

a thickness gauge, provided on a delivery side of said rolling mill including work rolls and backup rolls, for detecting a strip thickness deviation from a strip thickness set value;

a pulse generator for generating a pulse at every predetermined rotational angle of said backup roll;

a strip speed meter for detecting strip speed on the delivery side of said rolling mill;

a rotating time arithmetic unit for calculating a one-rotation time of said backup roll on the basis of the pulses outputted from said pulse generator;

a tracking unit for delaying an output of said thickness gauge by a strip transfer time corresponding to a difference between a strip transfer distance corresponding to one-rotation of said backup roll and a distance of said thickness gauge from said rolling mill;

a repetitive control arithmetic unit for making a repetitive control calculation of a strip thickness deviation; as a control quantity, in previous one-rotation of said backup roll which is outputted form said tracking unit;

a roll gap compensation quantity arithmetic unit for calculating a roll gap compensation quantity from an output of said repetitive control arithmetic unit; and a roll gap controller for controlling a roll gap of said rolling mill in accordance with the roll gap compensation quantity.

* * * * *